US012421843B2

(12) United States Patent
Tardy et al.

(10) Patent No.: US 12,421,843 B2
(45) Date of Patent: Sep. 23, 2025

(54) SYSTEMS AND METHODS FOR INFERRING RESERVOIR PRESSURE BASED ON INITIAL COILED TUBING RUN CONDITIONS

(71) Applicant: Schlumberger Technology Corporation, Sugar Land, TX (US)

(72) Inventors: Philippe Michel Jacques Tardy, Sugar Land, TX (US); Azwan Hadi Keong, Tananger (NO); Pavel Spesivtsev, Sugar Land, TX (US); Pierre Ramondenc, Clamart (FR); Jordi Juan Segura Dominguez, Tananger (NO); Laurence Fossati, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/464,737

(22) Filed: Sep. 11, 2023

(65) Prior Publication Data

US 2025/0084758 A1 Mar. 13, 2025

(51) Int. Cl.

| | |
|---|---|
| ***E21B 47/06*** | (2012.01) |
| ***E21B 47/047*** | (2012.01) |
| ***E21B 49/08*** | (2006.01) |

(52) U.S. Cl.

CPC ..... *E21B 47/06* (2013.01); *E21B 47/047* (2020.05); *E21B 49/08* (2013.01)

(58) Field of Classification Search

CPC ..... E21B 47/06; E21B 47/047; E21B 49/08

See application file for complete search history.

(56) References Cited

U.S. PATENT DOCUMENTS 10,648,293 B2 * 5/2020 Bhatnagar ..... G06F 30/20
11,619,124 B2 4/2023 Morrison
(Continued)

FOREIGN PATENT DOCUMENTS

WO 2022271589 A1 12/2022
WO 2024035758 A1 2/2024
(Continued)

OTHER PUBLICATIONS

Crabtree, A. R., "CT-Failure Monitoring: A Decade of Experience", SPE-113676-MS, Paper presented at the 2008 SPE/ICoTA Coiled Tubing and Well Intervention Conference and Exhibition, The Woodlands, TX, USA, 2008, 7 pages.
(Continued)

*Primary Examiner* — Catherine Loikith
(74) *Attorney, Agent, or Firm* — Jeffrey D. Frantz

(57) ABSTRACT

Systems and methods presented herein facilitate coiled tubing operations, and generally relate to automatically improving performance of coiled tubing operations in substantially real time by inferring reservoir pressure based on initial coiled tubing run conditions. For example, a method includes performing a coiled tubing operation via a coiled tubing system at least partially disposed within a wellbore. The method also includes detecting data relating to operating parameters of the coiled tubing operation via sensors of the coiled tubing system during the coiled tubing operation. The method further includes determining an initial wellbore fluid distribution in the wellbore based on the detected data prior to pumping fluid into the wellbore from a surface location relative to the wellbore. In addition, the method includes inferring a reservoir pressure of a hydrocarbon-bearing reservoir through which the wellbore extends based on the initial wellbore fluid distribution in the wellbore.

18 Claims, 10 Drawing Sheets

(56) References Cited

U.S. PATENT DOCUMENTS

| | | | |
|---|---|---|---|
| 2007/0277975 | A1 | 12/2007 | Lovell |
| 2009/0037113 | A1 | 2/2009 | Akram |
| 2019/0071941 | A1 | 3/2019 | Dobkins |
| 2023/0383646 | A1 | 11/2023 | Yip |
| 2024/0287859 | A1 | 8/2024 | Dvorak |
| 2024/0287860 | A1 | 8/2024 | Su |
| 2024/0287883 | A1 | 8/2024 | Tardy |
| 2024/0401461 | A1 | 12/2024 | Liu |
| 2024/0426183 | A1 | 12/2024 | Zheng |
| 2024/0426204 | A1 | 12/2024 | Segura |
| 2025/0020032 | A1 | 1/2025 | Morrison |
| 2025/0027402 | A1 | 1/2025 | Abuhaikal |
| 2025/0084754 | A1 | 3/2025 | Hassig Fonseca |

FOREIGN PATENT DOCUMENTS

| | | | |
|---|---|---|---|
| WO | 2024118706 | A1 | 6/2024 |
| WO | 2024151569 | A1 | 7/2024 |
| WO | 2024229316 | A1 | 11/2024 |

OTHER PUBLICATIONS

Hassig Fonseca, S., et al., "Surgical Coiled Tubing Stimulations: Step Changes in Effectiveness, Efficiency, and Characterization of Waterflooding Interventions", SPE-209028-PA, Spe Production & Operations, 2023, 38(01), pp. 73-87.

Newman, K. R. et al., "Development of a Standard Coiled-Tubing Fatigue Test", SPE-26539-MS, Paper presented at the 68th Annual Technical Conference and Exhibition of the Society of Petroleum Engineers, Houston, TX, USA, 1993, 7 pages.

Newman, K. R. et al., "Coiled-Tubing-Life Modeling", SPE-22820-MS, Paper presented at the SPE Annual Technical Conference and Exhibition, Dallas, Texas, U.S.A., 1991, 7 pages.

Segura, J. et al., "Coiled Tubing Autonomous Conveyance Improves Consistency of Offshore Intervention Operations", SPE-216196-MS, Paper presented at ADIPEC, Abu Dhabi, UAE, 2023, 14 pages.

Watkins, T. et al. "Novel Carbon Reduction Calculations for Fracturing Completions Using Sleeves and Darts", OTC-32590-MS, Paper presented at the Offshore Technology Conference, Houston, TX, USA, 2023, 22 pages.

Wu, J. "Coiled Tubing Working Life Prediction", SPE-29461-MS, Paper presented at the Production Operations Symposium, Oklahoma City, OK, U.S.A., 1995, 7 pages.

Zhao, C. et al., "Theoretical and Experimental Investigation of Coiled-Tubing Deformation Under Multiaxial Cyclic Loading", SPE191143-PA, SPE Drilling & Completions, 2018 33(03), pp. 220-229. SPE-191143-PA.

* cited by examiner

Gas-Oil-Water Initial Configuration

SYSTEMS AND METHODS FOR INFERRING RESERVOIR PRESSURE BASED ON INITIAL COILED TUBING RUN CONDITIONS

BACKGROUND

The present disclosure generally relates to systems and methods for automatically improving performance of coiled tubing operations in substantially real time by inferring reservoir pressure based on initial coiled tubing run conditions.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Coiled tubing is a technology that has been expanding its range of applications since its introduction to the oil industry in the 1960s. Its ability to pass through completion tubulars, as well as the wide array of tools and technologies that can be used in conjunction with it, make it a very versatile technology.

A typical coiled tubing apparatus includes surface pumping facilities, a coiled tubing string mounted on a reel, a method to convey the coiled tubing into and out of the wellbore, such as an injector head or the like, and surface control apparatus at the wellhead. Coiled tubing has been utilized for performing well treatment and/or well intervention operations in existing wellbores such as, but not limited to, hydraulic fracturing operations, matrix acidizing operations, milling operations, perforating operations, cleanout operations, coiled tubing drilling operations, nitrogen kick-off operations, fishing operations, zonal isolation operations, and so forth.

Coiled tubing cleanout operations are utilized to transport particles and fill from a wellbore to the wellbore surface. Sources of the particles and fill may include formation sand or chalk from the reservoir, proppant used for hydraulic fracturing, mechanical or dissolvable plugs, debris from workovers, and organic or inorganic scales, among other sources.

Coiled tubing cleanout and descaling operations can be relatively complex operations that, in order to successfully accomplish transporting particles and fill to the wellbore surface, need to account for various factors for success that include, but are not limited to, wellbore hydraulics, movement of the coiled tubing, reservoir flow and coupling between the wellbore and the reservoir, nitrified fluids injection, solid transport, phase changes, and temperature evolution and distribution along the wellbore.

It remains desirable to provide improvements in oilfield surface equipment and/or downhole assemblies and methods of using such equipment or assemblies such as, but not limited to, methods for optimizing coiled tubing operations including, but not limited to, cleanout operations. For example, it may be advantageous to analyze reservoir pressures, pressure drawdown, and reservoir flow, which translates into the term "productivity index" of reservoir productivity.

SUMMARY

A summary of certain embodiments described herein is set forth below. It should be understood that these aspects are presented merely to provide the reader with a brief summary of these certain embodiments and that these aspects are not intended to limit the scope of this disclosure.

Certain embodiments of the present disclosure include a method that includes performing a coiled tubing operation via a coiled tubing system at least partially disposed within a wellbore. The method also includes detecting data relating to one or more operating parameters of the coiled tubing operation via one or more sensors of the coiled tubing system during the coiled tubing operation. The method further includes determining an initial wellbore fluid distribution in the wellbore based at least in part on the detected data prior to pumping fluid into the wellbore from a surface location relative to the wellbore. In addition, the method includes inferring a reservoir pressure of a hydrocarbon-bearing reservoir through which the wellbore extends based at least in part on the initial wellbore fluid distribution in the wellbore.

Certain embodiments of the present disclosure also include a processing and control system that includes one or more processors configured to execute processor-executable instructions stored in memory media of the processing and control system. The processor-executable instructions, when executed by the one or more processors, cause the processing and control system to receive data relating to one or more operating parameters of the coiled tubing operation detected by one or more sensors of a coiled tubing system during a coiled tubing operation; determine an initial wellbore fluid distribution in the wellbore based at least in part on the detected data prior to pumping fluid into the wellbore from a surface location relative to the wellbore; and infer a reservoir pressure of a hydrocarbon-bearing reservoir through which the wellbore extends based at least in part on the initial wellbore fluid distribution in the wellbore.

Certain embodiments of the present disclosure also include a method that includes performing a coiled tubing operation via a coiled tubing system at least partially disposed within a wellbore. The method also includes detecting data relating to one or more operating parameters of the coiled tubing operation via one or more sensors of the coiled tubing system during the coiled tubing operation. The method further includes determining an average density of a fluid mixture in the wellbore between a bottom hole assembly (BHA) of the coiled tubing system and a downhole pressure gauge based at least in part on the detected data prior to pumping fluid into the wellbore from a surface location relative to the wellbore. In addition, the method includes inferring a reservoir pressure of a hydrocarbon-bearing reservoir through which the wellbore extends based at least in part on the average density of the fluid mixture in the wellbore between the BHA of the coiled tubing system and the downhole pressure gauge.

As described in greater detail herein, the inferred data may be used to determine the starting depth of circulation for a coiled tubing cleanout operation (which also includes coiled tubing descaling operations), as a result of inferring data to produce the correct reservoir pressure. Knowing the starting depth for circulation through inferred data, in a way, validates the model by confirmation of fluid return at the surface within an expected time.

It should be noted that while the embodiments described herein are primarily directed to coiled tubing cleanout operations, in general, the techniques described herein may be extended to any number of other types of coiled tubing operations.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1:
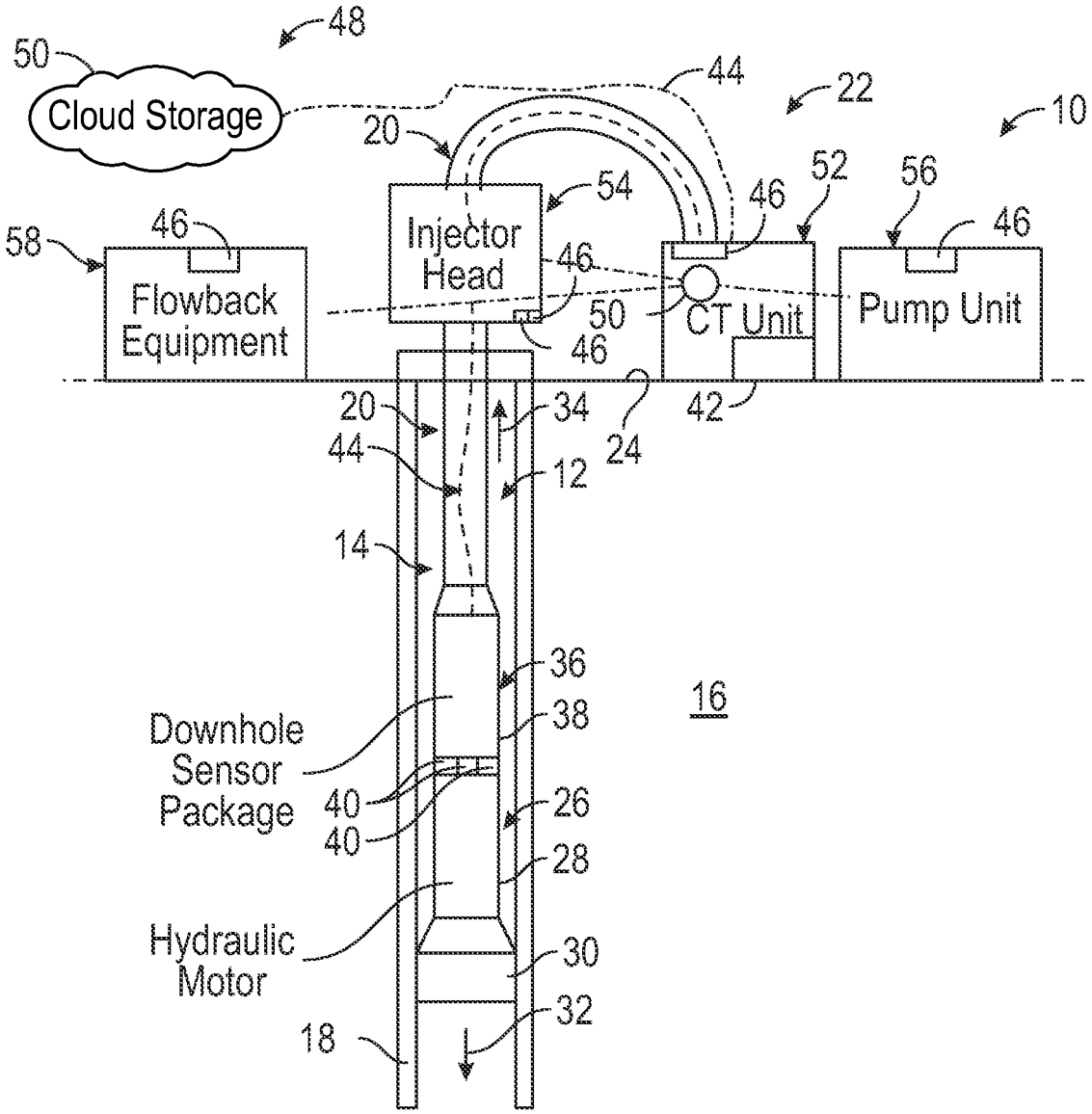
FIG. 1 illustrates a schematic diagram of an example coiled tubing system, in accordance with embodiments of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

In addition, as used herein, the terms "real time", "real-time", or "substantially real time" may be used interchangeably and are intended to described operations (e.g., computing operations) that are performed without any human-perceivable interruption between operations. For example, as used herein, data relating to the systems described herein may be collected, transmitted, and/or used in control computations in "substantially real time" such that data readings, data transfers, and/or data processing steps occur once every second, once every 0.1 second, once every 0.01 second, or even more frequent, during operations of the systems (e.g., while the systems are operating). In addition, as used herein, the terms "automatic" and "automated" are intended to describe operations that are performed are caused to be performed, for example, by a processing system (i.e., solely by the processing system, without human intervention). In addition, as used herein, the term "approximately equal to" may be used to mean values that are relatively close to each other (e.g., within 5%, within 2%, within 1%, within 0.5%, or even closer, of each other).

During the life of an oil or gas production well, solid particles (e.g., such as sand or chalk) produced from unconsolidated formations or proppant left in the wellbore after an earlier fracturing job may settle at various depths along the wellbore. In some cases, they may accumulate into solid fills or form deep solid beds over significant distances in the wellbore. Cleanout Operations with Coiled Tubing (CTCO) consist in flushing these solid particles to surface by injecting fluids through the end of coiled tubing, next to where the solids lay in the wellbore. By supplying enough flow, the particles may remain suspended in the injected fluids and transported to surface.

In other cases, inorganic deposits (e.g., pyrite $FeS_2$ or pyrrhotite $Fe_7S_8$) may be produced during the life of an oil or gas production well, and accumulate in the wellbore, thus preventing optimal circulation of hydrocarbons to the surface and thus impairing production. In those cases, descaling operations would be executed to break down the deposits (often by a combination of specialized chemical systems and the use of mechanical means, such as milling bits) and circulate them back to the surface to restore the production. Such operations are often assimilated to cleanout operations and, for the sake of the present disclosure, will be included under the more general term "cleanout" since their objective is to remove debris from the wellbore and circulate them back to the surface.

To design a cleanout job, engineers often use computer programs that can simulate all the relevant physical phenomena occurring during such operations. Using such simulators, engineers investigate options such as pump rates, fluids to be pumped, coiled tubing movements that may provide the optimum CTCO, and so forth. In many situations, some input parameters required by the simulators are not known with sufficient accuracy for the simulator's predictions to be reliable. For instance, the initial position and size of the solid fills in the wellbore is typically not known accurately prior to running the coiled tubing into hole. In other cases, it may be the debris size distribution and density that are unknown. In such cases, defining a CTCO design may be very challenging.

Acquisition data sets obtained during CTCOs in sub-hydrostatic wells have shown that it may be possible to determine the initial wellbore fluid distribution prior to the start of pumping, in particular, the depth of the gas-oil interface and the depth of the oil-water interface. One objective of using the real-time automation methodology described herein is to obtain an early estimate of the reservoir pressure using inferred initial fluid distribution before the wellbore fluid system becomes perturbated by flow associated with the cleanout operation. With an estimate of the average reservoir pressure, an earlier assessment as to whether the CTCO is being performed in under- or over-balanced conditions such that, for example, operational adjustments may be implemented. It should be noted that while the embodiments described herein are primarily directed to CTCOs, in general, the techniques described herein may be extended to any number of other types of coiled tubing operations when fluid circulation is required and under- or over-balanced conditions are uncertain or of critical importance to the performance of the coiled tubing intervention.

The embodiments described herein may also be used to check that the maximum tolerable drawdown is not exceeded as to minimize the risk of solid influx from the reservoir into the wellbore. Additionally, determination of the initial depth of the gas-liquid interface in the wellbore may impact the decision on the coiled tubing depth at which the initial kickoff should be operated and whether gas-lift may be efficient. In addition, other more mechanically impacted decisions may be made based on the determination of the initial depth of a gas-liquid interface, such as friction correlation for tension modelling to accurately predict coiled tubing tension at different depths, identifying depths for which risk of abrasion may be relatively high in a dry environment, and so forth. These determinations enable mitigating actions to be taken accordingly prior to running in hole.

With the foregoing in mind, FIG. 1 illustrates a schematic diagram of an example coiled tubing system 10. As illustrated, in certain embodiments, a coiled tubing string 12 may be run into a wellbore 14 that traverses a hydrocarbon-bearing formation 16 (i.e., reservoir). While certain elements of the coiled tubing system 10 are illustrated in FIG. 1, other elements of the coiled tubing system 10 (e.g., blow-out preventers, wellhead "tree", etc.) may be omitted for clarity of illustration. In certain embodiments, the coiled tubing system 10 includes an interconnection of pipes, including vertical and/or horizontal casings 18, coiled tubing 20, and so forth, that connect to a surface facility 22 at the surface 24 of the coiled tubing system 10. In certain embodiments, the coiled tubing 20 extends inside the casing 18 and terminates at a tubing head (not shown) at or near the surface 24. In addition, in certain embodiments, the casing 18 contacts the wellbore 14 and terminates at a casing head (not shown) at or near the surface 24.

In certain embodiments, a bottom hole assembly ("BHA") 26 may be run inside the casing 18 by the coiled tubing 20. As illustrated in FIG. 1, in certain embodiments, the BHA 26 may include a downhole motor 28 that operates to rotate a drill bit 30 (e.g., during drilling operations) or other downhole tools. In certain embodiments, the downhole motor 28 may be driven by hydraulic forces carried in fluid supplied from the surface 24 of the coiled tubing system 10. In certain embodiments, the BHA 26 may be connected to the coiled tubing 20, which is used to run the BHA 26 to a desired location within the wellbore 14. It is also contemplated that, in certain embodiments, the rotary motion of the drill bit 30 may be driven by rotation of the coiled tubing 20 effectuated by a rotary table or other surface-located rotary actuator. In such embodiments, the downhole motor 28 may be omitted.

In certain embodiments, the coiled tubing 20 may also be used to deliver fluid 32 to the drill bit 30 through an interior of the coiled tubing 20 to aid in the drilling process and carry cuttings and possibly other fluid or solid components in return fluid 34 that flows up the annulus between the coiled tubing 20 and the casing 18 (or via a return flow path provided by the coiled tubing 20, in certain embodiments) for return to the surface facility 22. It is also contemplated that the return fluid 34 may include remnant proppant (e.g., sand) or possibly rock fragments that result from a hydraulic fracturing application, and flow within the coiled tubing system 10. Under certain conditions, fracturing fluid and possibly hydrocarbons (oil and/or gas), proppants and possibly rock fragments may flow from the fractured formation 16 through perforations in a newly opened interval and back to the surface 24 of the coiled tubing system 10 as part of the return fluid 34. In certain embodiments, the BHA 26 may be supplemented behind the rotary drill by an isolation device such as, for example, an inflatable packer that may be activated to isolate the zone below or above it and enable local pressure tests.

As such, in certain embodiments, the coiled tubing system 10 may include a downhole well tool 36 that is moved along the wellbore 14 via the coiled tubing 20. In certain embodiments, the downhole well tool 36 may include a variety of drilling/cutting tools coupled with the coiled tubing 20 to provide a coiled tubing string 12. In the illustrated embodiment, the downhole well tool 36 includes the drill bit 30, which may be powered by the downhole motor 28 (e.g., a positive displacement motor (PDM), or other hydraulic motor) of the BHA 26. In certain embodiments, the wellbore 14 may be an open wellbore or a cased wellbore defined by the casing 18. In addition, in certain embodiments, the wellbore 14 may be vertical or horizontal or inclined. It should be noted the downhole well tool 36 may be part of various types of BHAs 26 coupled to the coiled tubing 20.

As also illustrated in FIG. 1, in certain embodiments, the coiled tubing system 10 may include a downhole sensor package 38 having multiple downhole sensors 40. In certain embodiments, the sensor package 38 may be mounted along the coiled tubing string 12, although certain downhole sensors 40 may be positioned at other downhole locations in other embodiments. In addition, in certain embodiments, downhole sensors 40 disposed on the coiled tubing 20 may be configured to detect downhole flow rates, downhole temperatures, and downhole pressures, and so forth, in the wellbore 14. In addition, in certain embodiments, downhole sensors 40 disposed on the casing 18 may be configured to detect downhole temperatures, and downhole pressures, and so forth, in the wellbore 14.

In certain embodiments, data from the downhole sensors 40 may be relayed uphole to a surface processing system 42 (e.g., a computer-based processing system) disposed at the surface 24 and/or other suitable location of the coiled tubing system 10. In certain embodiments, the data may be relayed uphole in substantially real time (e.g., relayed while it is detected by the downhole sensors 40 during operation of the downhole well tool 36) via a wired or wireless telemetric control line 44, and this real-time data may be referred to as edge data. In certain embodiments, the telemetric control line 44 may be in the form of an electrical line, fiber-optic line, or other suitable control line for transmitting data signals. In certain embodiments, the telemetric control line 44 may be routed along an interior of the coiled tubing 20, within a wall of the coiled tubing 20, or along an exterior of the coiled tubing 20. In addition, as described in greater detail herein, additional data (e.g., surface data) may be supplied by surface sensors 46 and/or stored in a memory location 48. By way of example, historical data and other useful data may be stored in the memory location 48 such as a cloud storage 50.

As illustrated, in certain embodiments, the coiled tubing 20 may deployed by a coiled tubing unit 52 and delivered downhole via an injector head 54. In certain embodiments, the injector head 54 may be controlled to slack off or pick up the coiled tubing 20 so as to control the tubing string weight and, thus, the weight on bit (WOB) or torque acting on the drill bit 30 (or the downhole well tool 36). In certain embodiments, the downhole well tool 36 may be moved along the wellbore 14 via the coiled tubing 20 under control of the injector head 54 so as to apply a desired tubing weight and, thus, to achieve a desired rate of penetration (ROP) as the drill bit 30 is operated. Depending on the specifics of a given application, various types of data may be collected downhole, and transmitted to the surface processing system 42 in substantially real time to facilitate improved operation of the downhole well tool 36. For example, the data may be used to fully or partially automate downhole operations, to optimize the downhole operations, and/or to provide more accurate predictions regarding components or aspects of the downhole operations.

In certain embodiments, fluid 32 may be delivered downhole under pressure from a pump unit 56. In certain embodiments, the fluid 32 may be delivered by the pump unit 56 through the downhole hydraulic motor 28 to power the downhole hydraulic motor 28 and, thus, the drill bit 30. In certain embodiments, the return fluid 34 is returned uphole, and this flow back of the return fluid 34 is controlled by suitable flowback equipment 58. In certain embodiments, the flowback equipment 58 may include chokes and other components/equipment used to control flow back of the return fluid 34 in a variety of applications, including well treatment applications.

As described in greater detail herein, the coiled tubing unit 52, the injector head 54, the pump unit 56, and the flowback equipment 58 may include advanced surface sensors 46, actuators, and local controllers, such as PLCs, which may cooperate together to provide sensor data to, receive control signals from, and generate local control signals based on communications with, respectively, the surface processing system 42. In certain embodiments, as described in greater detail herein, the surface sensors 46 may include flow rate, pressure, and fluid rheology sensors 46, among other types of sensors. In addition, as described in greater detail herein, the actuators may include actuators for pump and choke control of the pump unit 56 and the flowback equipment 58, respectively, among other types of actuators.

In certain embodiments, surface sensors 46 of the coiled tubing unit 52 may be configured to detect positions of the coiled tubing 20, weights of the coiled tubing 20, and so forth. In addition, in certain embodiments, surface sensors 46 of the injector head 54 may be configured to detect wellhead pressure, and so forth. In addition, in certain embodiments, surface sensors 46 of the pump unit 56 may be configured to detect pump pressures, pump flow rates, and so forth. In addition, in certain embodiments, surface sensors 46 of the flowback equipment 58 may be configured to detect fluids production rates, solids production rates, and so forth.

The embodiments described herein utilize a calibrated FM to determine the wellbore depth at which the solids, seen in the production fluids at the surface or detected by other means, originated initially. Once determined, a CTCO operator may consider bringing the coiled tubing 20 to the estimated depth of the solids origin (DSO) and using the calibrated FM to investigate options to ensure that either no particles are left at that DSO or that the amount that can be cleaned generates the maximum return of investment while keeping operation safe.

Figure 2:
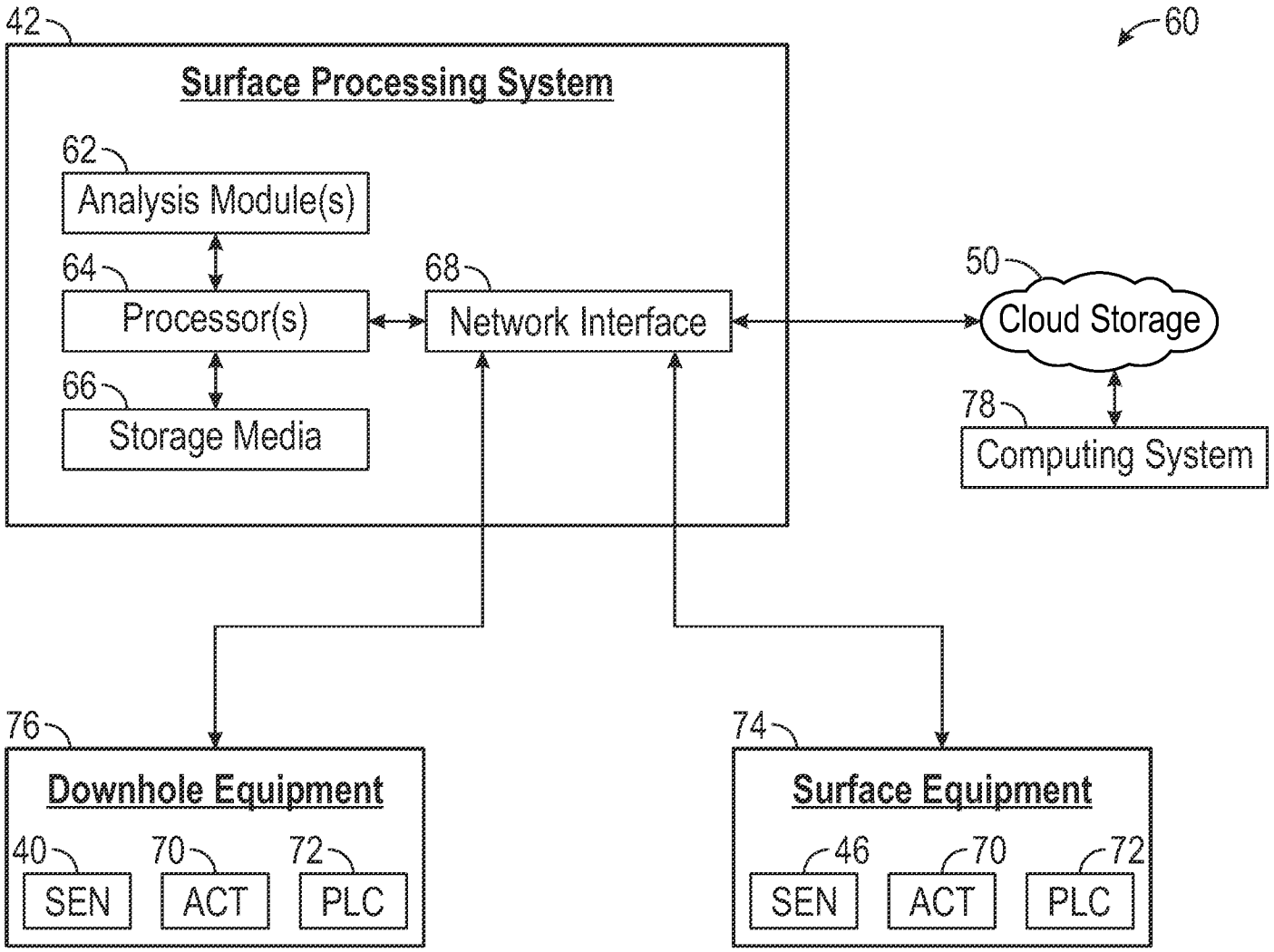
FIG. 2 illustrates a well control system including a surface processing system to control the coiled tubing system of FIG. 1, in accordance with embodiments of the present disclosure.

FIG. 2 illustrates a well control system 60 that may include the surface processing system 42 to control the coiled tubing system 10 described herein. In certain embodiments, the surface processing system 42 may include one or more analysis modules 62 (e.g., a program of computer-executable instructions and associated data) that may be configured to perform various functions of the embodiments described herein. In certain embodiments, to perform these various functions, the one or more analysis modules 62 may execute on one or more processors 64 of the surface processing system 42, which may be connected to one or more storage media 66 of the surface processing system 42. Indeed, in certain embodiments, the one or more analysis modules 62 may be stored in the one or more storage media 66.

In certain embodiments, the computer-executable instructions of the one or more analysis modules 62, when executed by the one or more processors 64, may cause the one or more processors 64 to generate one or more models (e.g., including the FM described in greater detail herein). Such models may be used by the surface processing system 42 to predict values of operational parameters that may or may not be measured (e.g., using gauges, sensors) during well operations.

In certain embodiments, the one or more processors 64 may include a microprocessor, a microcontroller, a processor module or subsystem, a programmable integrated circuit, a programmable gate array, a digital signal processor (DSP), or another control or computing device. In certain embodiments, the one or more processors 64 may include machine learning and/or artificial intelligence (AI) based processors. In certain embodiments, the one or more storage media 66 may be implemented as one or more non-transitory computer-readable or machine-readable storage media. In certain embodiments, the one or more storage media 66 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the computer-executable instructions and associated data of the analysis module(s) 62 may be provided on one computer-readable or machine-readable storage medium of the storage media 66, or alternatively, may be provided on multiple computer-readable or machine-readable storage media distributed in a large system having possibly plural nodes. Such computer-readable or machine-readable storage medium or media are considered to be part of an article (or article of manufacture), which may refer to any manufactured single component or multiple components. In certain embodiments, the one or more storage media 66 may be located either in the machine running the machine-readable instructions, or may be located at a remote site from which machine-readable instructions may be downloaded over a network for execution.

In certain embodiments, the processor(s) 64 may be connected to a network interface 68 of the surface processing system 42 to allow the surface processing system 42 to communicate with the multiple downhole sensors 40 and surface sensors 46 described herein, as well as communicate with the actuators 70 and/or PLCs 72 of the surface equipment 74 (e.g., the coiled tubing unit 52, the pump unit 56, the flowback equipment 58, and so forth) and of the downhole equipment 76 (e.g., the BHA 26, the downhole motor 28, the drill bit 30, the downhole well tool 36, and so forth) for the purpose of controlling operation of the coiled tubing system 10, as described in greater detail herein. In certain embodiments, the network interface 68 may also facilitate the surface processing system 42 to communicate data to the cloud storage 50 (or other wired and/or wireless communication network) to, for example, archive the data or to enable external computing systems 78 to access the data and/or to remotely interact with the surface processing system 42.

It should be appreciated that the well control system 60 illustrated in FIG. 2 is only one example of a well control system, and that the well control system 60 may have more or fewer components than shown, may combine additional components not depicted in the embodiment of FIG. 2, and/or the well control system 60 may have a different configuration or arrangement of the components depicted in FIG. 2. In addition, the various components illustrated in FIG. 2 may be implemented in hardware, software, or a combination of both hardware and software, including one or more signal processing and/or application specific integrated circuits. Furthermore, the operations of the well control system 60 as described herein may be implemented by running one or more functional modules in an information processing apparatus such as application specific chips, such as application-specific integrated circuits (ASICs), field-programmable gate arrays (FPGAs), programmable logic devices (PLDs), systems on a chip (SOCs), or other appropriate devices. These modules, combinations of these modules, and/or their combination with hardware are all included within the scope of the embodiments described herein.

As described in greater detail herein, the embodiments described herein facilitate the operation of well-related tools. For example, a variety of data (e.g., downhole data and surface data) may be collected to enable optimization of operations of well-related tools such as the downhole well tool 36 illustrated in FIG. 1 by the surface processing system 42 illustrated in FIG. 2 (or other suitable processing systems). In certain embodiments, the data may be provided as advisory data by the surface processing system 42 (or other suitable processing systems). However, in other embodiments, the data may be used to facilitate automation of downhole processes and/or surface processes (i.e., the processes may be automated without human intervention), as described in greater detail herein, by the surface processing system 42 (or other suitable processing system). The embodiments described herein may enhance downhole operations by improving the efficiency and utilization of data to enable performance optimization and improved resource controls.

As described in greater detail herein, in certain embodiments, downhole parameters may be obtained via, for example, downhole sensors 40 while the downhole well tool 36 is disposed within the wellbore 14. In certain embodiments, the downhole parameters may be obtained in substantially real time and sent to the surface processing system 42 via wired or wireless telemetry. In certain embodiments, downhole parameters may be combined with surface parameters by the surface processing system 42. In certain embodiments, the downhole and surface parameters may be processed by the surface processing system 42 during use of the downhole well tool 36 to enable automatic (e.g., without human intervention) optimization with respect to use of the downhole well tool 36 during subsequent stages of operation of the downhole well tool 36.

Non-limiting examples of downhole parameters that may be sensed in substantially real time include, but are not limited to, weight on bit (WOB), torque acting on the downhole well tool 36, downhole pressures, downhole differential pressures, downhole temperatures, downhole fluid velocities and fluid direction, and other desired downhole parameters. In certain embodiments, downhole parameters may be used by the surface processing system 42 in combination with surface parameters, and such surface parameters may include, but are not limited to, pump-related parameters (e.g., pump rate and circulating pressures of the pump unit 56). In certain embodiments, the surface parameters also may include parameters related to fluid returns (e.g., wellhead pressure, return fluid flow rate, choke settings, amount of proppant returned, and other desired surface parameters). In certain embodiments, the surface parameters also may include data from the coiled tubing unit 52 (e.g., surface weight of the coiled tubing string 12, speed of the coiled tubing 20, rate of penetration, and other desired parameters). In certain embodiments, the surface data that may be processed by the surface processing system 42 to optimize performance also may include previously recorded data such as fracturing data (e.g., close-in pressures from each fracturing stage, proppant data, friction data, fluid volume data, and other desired data).

In certain embodiments, use of the downhole data and surface data enables the surface processing system 42 to self-learn (e.g., modeling or simulation using the machine learning or artificial intelligence (AI) based processors, machine learning or AI based algorithms stored in the one or more storage media 66, or combinations thereof). This real-time modeling by the surface processing system 42, based on the downhole and surface parameters, enables improved downhole operations. Such modeling by the surface processing system 42 also enables the downhole process to be automated and automatically optimized by the surface processing system 42. For instance, the modeling based on the downhole parameters may be used by the surface processing system 42 to predict wear on the downhole motor 28 and/or the drill bit 30, and to advise as to timing of the next trip to the surface for replacement of the downhole motor 28 and/or the drill bit 30.

In certain embodiments, the modeling based on the downhole parameters also enable use of pressures to be used by the surface processing system 42 in characterizing the formation 16. Such real-time downhole parameters also enable use of pressures by the surface processing system 42 for in situ evaluation and advisory of post-fracturing flow back parameters, and for creating an optimum flow back schedule for maximized production of, for example, hydrocarbon fluids from the surrounding formation 16. Data available from a given well may be utilized in designing the next fracturing schedule for the same pad/neighbor wells as well as predictions regarding subsequent wells.

For example, downhole data such as WOB, torque data from a load module associated with the downhole well tool 36, and bottom hole pressures (internal and external to the bottom hole assembly 26/downhole well tool 36) may be processed via the surface processing system 42. The processed data may then be utilized by the surface processing system 42 to control the injector head 54 to generate, for example, a faster and more controlled rate of penetration (ROP). Additionally, the processed data may be updated by the surface processing system 42 as the downhole well tool 36 is moved to different positions along the wellbore 14 to help optimize operations. The processed data also enables automation of the downhole process through automated controls over the injector head 54 via control instructions provided by the surface processing system 42.

In certain embodiments, data from downhole may be combined by the surface processing system 42 with surface data received from injector head 54 and/or other measured or stored surface data. By way of example, surface data may include hanging weight of the coiled tubing string 12, speed of the coiled tubing 20, wellhead pressure, choke and flow back pressures, return pump rates, circulating pressures (e.g., circulating pressures from the manifold of a coiled tubing reel in the coiled tubing unit 52), and pump rates. The surface data may be combined with the downhole data by the surface processing system 42 in real time to provide an automated system that self-controls the injector head 54. For example, the injector head 54 may be automatically controlled (e.g., without human intervention) to optimize ROP under direction from the surface processing system 42.

In certain embodiments, data from drilling parameters (e.g., surveys and pressures) as well as fracturing parameters (e.g., volumes and pressures) may be combined with real-time data obtained from sensors 40, 46. The combined data may be used by the surface processing system 42 in a manner that aids in machine learning and/or artificial intelligence to automate subsequent jobs in the same well and/or for neighboring wells. The accurate combination of data and the updating of that data in real time helps the surface processing system 42 improve the automatic performance of subsequent tasks.

In certain embodiments, depending on the type of operation downhole, the surface processing system 42 may be programmed with a variety of algorithms and/or modeling techniques to achieve desired results. For example, the downhole data and surface data may be combined and at least some of the data may be updated in real time by the surface processing system 42. This updated data may be processed by the surface processing system 42 via suitable algorithms to enable automation and to improve the performance of, for example, downhole well tool 36. By way of example, the data may be processed and used by the surface processing system 42 for preventing motor stalls. In certain embodiments, downhole parameters such as forces, torque, and pressure differentials may be combined by the surface processing system 42 to enable prediction of a next stall of the downhole motor 28 and/or to give a warning to a supervisor. In such embodiments, the surface processing system 42 may be programmed to make self-adjustments (e.g., automatically, without human intervention) to, for example, speed of the injector head 54 and/or pump pressures to prevent the stall, and to ensure efficient continuous operation.

In addition, in certain embodiments, the data and the ongoing collection of data may be used by the surface processing system 42 to monitor various aspects of the performance of downhole motor 28. For example, motor wear may be detected by monitoring the effective torque of the downhole motor 28 based on data obtained regarding pump rates, pressure differentials, and actual torque measurements of the downhole well tool 36. Various algorithms may be used by the surface processing system 42 to help a supervisor on site to predict, for example, how many more hours the downhole motor 28 may be run efficiently. This data, and the appropriate processing of the data, may be used by the surface processing system 42 to make automatic decisions or to provide indications to a supervisor as to when to pull the coiled tubing string 12 to the surface to replace the downhole motor 28, the drill bit 30, or both, while avoiding unnecessary trips to the surface.

In certain embodiments, downhole data and surface data also may be processed via the surface processing system 42 to predict a time when the coiled tubing string 12 may become stuck. The ability to predict when the coiled tubing string 12 may become stuck helps avoid unnecessary short trips and, thus, improves coiled tubing pipe longevity. In certain embodiments, downhole parameters such as forces, torque, and pressure differentials in combination with surface parameters such as weight of the coiled tubing 20, speed of the coiled tubing 20, pump rate, and circulating pressure may be processed via the surface processing system 42 to provide predictions as to the time when the coiled tubing 20 will become stuck.

In certain embodiments, the surface processing system 42 may be designed to provide warnings to a supervisor and/or to self-adjust (e.g., automatically, without human intervention) either the speed of the injector head 54, the pump pressures and rates of the pump unit 56, or a combination of both, so as to prevent the coiled tubing 20 from getting stuck based on the predictions described herein. By way of example, the warnings or other information may be output to a display of the surface processing system 42 to enable an operator to make better, more informed decisions regarding downhole or surface processes related to operation of the downhole well tool 36. In certain embodiments, the speed of the injector head 54 may be controlled via the surface processing system 42 by controlling the slack-off force from the surface. In general, the ability to predict and prevent the coiled tubing 20 from becoming stuck substantially improves the overall efficiency and helps avoid unnecessary short trips if the probability of the coiled tubing 20 getting stuck is minimal. Accordingly, the downhole data and surface data may be used by the surface processing system 42 to provide advisory information and/or automation of surface processes, such as pumping processes or other processes.

As described above, acquisition data sets obtained during CTCOs in sub-hydrostatic wells have shown that it may be possible to determine the initial wellbore fluid distribution prior to the start of pumping, in particular, the depth of the gas-oil interface and the depth of the oil-water interface. One objective of using the real-time automation methodology described herein is to obtain an early estimate of the reservoir pressure using inferred initial fluid distribution before the wellbore fluid system becomes perturbated by flow associated with the cleanout operation. With an estimate of the average reservoir pressure, an earlier assessment as to whether the CTCO is being performed in under- or over-balanced conditions such that, for example, operational adjustments may be implemented. The embodiments described herein may also be used to check that the maximum tolerable drawdown is not exceeded as to minimize the risk of solid influx from the reservoir 16 into the wellbore 14. Additionally, determination of the initial depth of the gas-liquid interface in the wellbore 14 may impact the decision on the coiled tubing depth at which the initial kickoff should be operated and whether gas-lift may be efficient.

Figure 3:
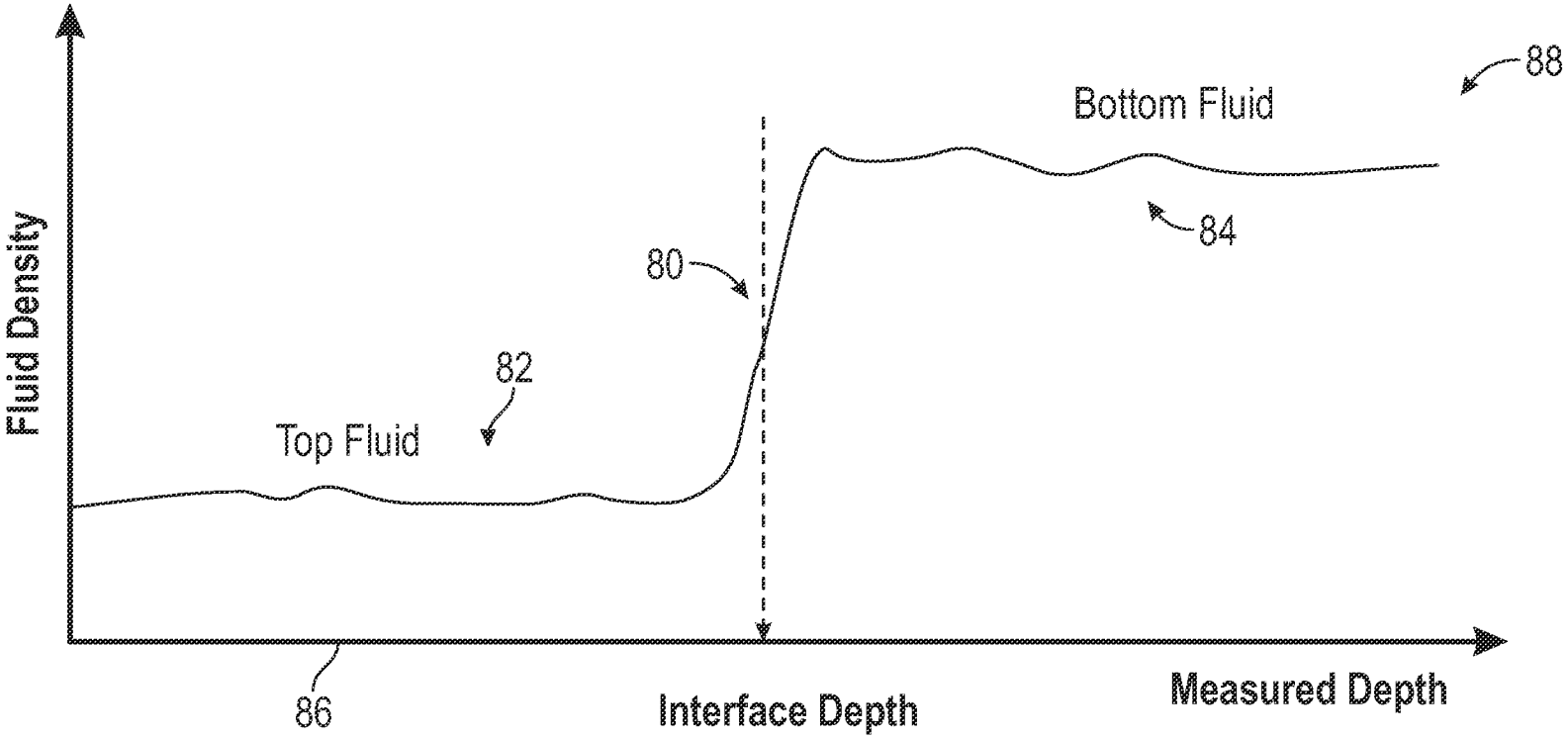
FIG. 3 is a fluid density profile calculated during data acquisition, showing a fluid-fluid interface, in accordance with embodiments of the present disclosure.

The methodology described herein may apply to a first CTCO run, as subsequent runs may have less stable initial conditions and since the reservoir pressure estimated from the first run should also apply to the subsequent ones. The methodology is based on the field observation that, before pumping starts and while the well is shut-in, interfaces 80 between two fluids 82, 84 of different densities (e.g., a top fluid 82 and a bottom fluid 84) may be present at certain depths 86 along the wellbore 14, as illustrated in the fluid density profile 88 illustrated in FIG. 3. In many cases encountered with CTCOs, the top fluid 82 may be a gas, and the bottom fluid 84 may be either water or oil, or both. The embodiments described herein consider cases where up to three fluids initially fill the wellbore 14, these fluids being gas, oil, and water, which could give rise to three potential interface types, gas-oil, gas-water, and oil-water. In any situation, at most two of these interfaces may be present at once in a given wellbore 14. Once the initial wellbore fluid distribution is determined, the reservoir pressure may be calculated by hydrostatic extrapolations, assuming that no significant flow is occurring during the initial Running into Hole (RIH). The methodology described herein relies on three types of pressure sensors:

- A Wellhead Pressure (WHP) sensor measuring wellbore pressure at the depth, or near, the wellhead in a part of the flow path in hydraulic communication with the BHA 26;
- A Bottom Hole Assembly (BHA) pressure sensor measuring wellbore fluid pressure in the annulus around the end of the coiled tubing 20; and
- A Downhole Pressure Gauge (DHPG) (e.g., of a wellbore completion system) measuring the wellbore fluid pressure near the production interval.

The following notations are used to facilitate discussion of the methodology presented herein:

- $MD_{bha}$: measured depth of the coiled tubing 20 (depth of the BHA 26);
- $MD_{dhpg}$: measured depth of the DHPG;
- $MD_{go}$: measured depth of the gas-oil contact in the wellbore 14;
- $MD_{ow}$: measured depth of the oil-water contact in the wellbore 14;
- $TVD_{bha}$: true vertical depth (TVD) of the coiled tubing 20 (depth of the BHA 26);
- $TVD_{dhpg}$: TVD of the DHPG;
- $TVD_{go}$: TVD of the gas-oil contact in the wellbore 14;
- $TVD_{ow}$: TVD of the oil-water contact in the wellbore 14;
- $\rho_{bha}$: density of the fluid in the annulus around the BHA 26;
- $\bar{\rho}_{bha}$ the average of $\rho_{bha}$ between two different TVDs;
- $\langle\rho\rangle$: average density of the fluid mixture in the wellbore 14 between the BHA 26 and the DHPG;
- $\rho_g$: gas density;
- $\rho_o$: oil density;
- $\rho_w$: brine density;
- $p_{res}$: pressure of the reservoir 16;
- $p_{wh}$: pressure in the wellbore 14;
- $p_{dhpg}$: downhole pressure at the DHPG; and
- $p_{bha}$: annular pressure at the BHA 26.

If the stable wellhead pressure $p_{wh}$ and the stable downhole pressure $p_{dhpg}$ is known (e.g., from the DHPG) during the shut-in before the job intervention, an average wellbore fluid density $\langle\rho\rangle$ may be determined for the fluid mixture between the wellhead and the DHPG using equation (1):

$$\langle\rho\rangle(MD_{bha}=0)=\frac{1}{9.81}\frac{p_{dhpg}-p_{wh}}{TVD_{dhpg}} \tag{1}$$

This value of $\langle\rho\rangle$ may be obtained by multiple combinations of gas on top of oil on top of water volumes using equation (2):

$$\begin{aligned} p_{dhpg} &= p_{wh}+9.81\langle\rho\rangle(MD_{bha}=0)TVD_{dhpg} \\ &= p_{wh}+9.81\rho_g TVD_{go}+9.81\rho_o(TVD_{ow}-TVD_{go})+ \\ &\quad 9.81\rho_w(TVD_{dhpg}-TVD_{ow}) \end{aligned} \tag{2}$$

Figure 4:
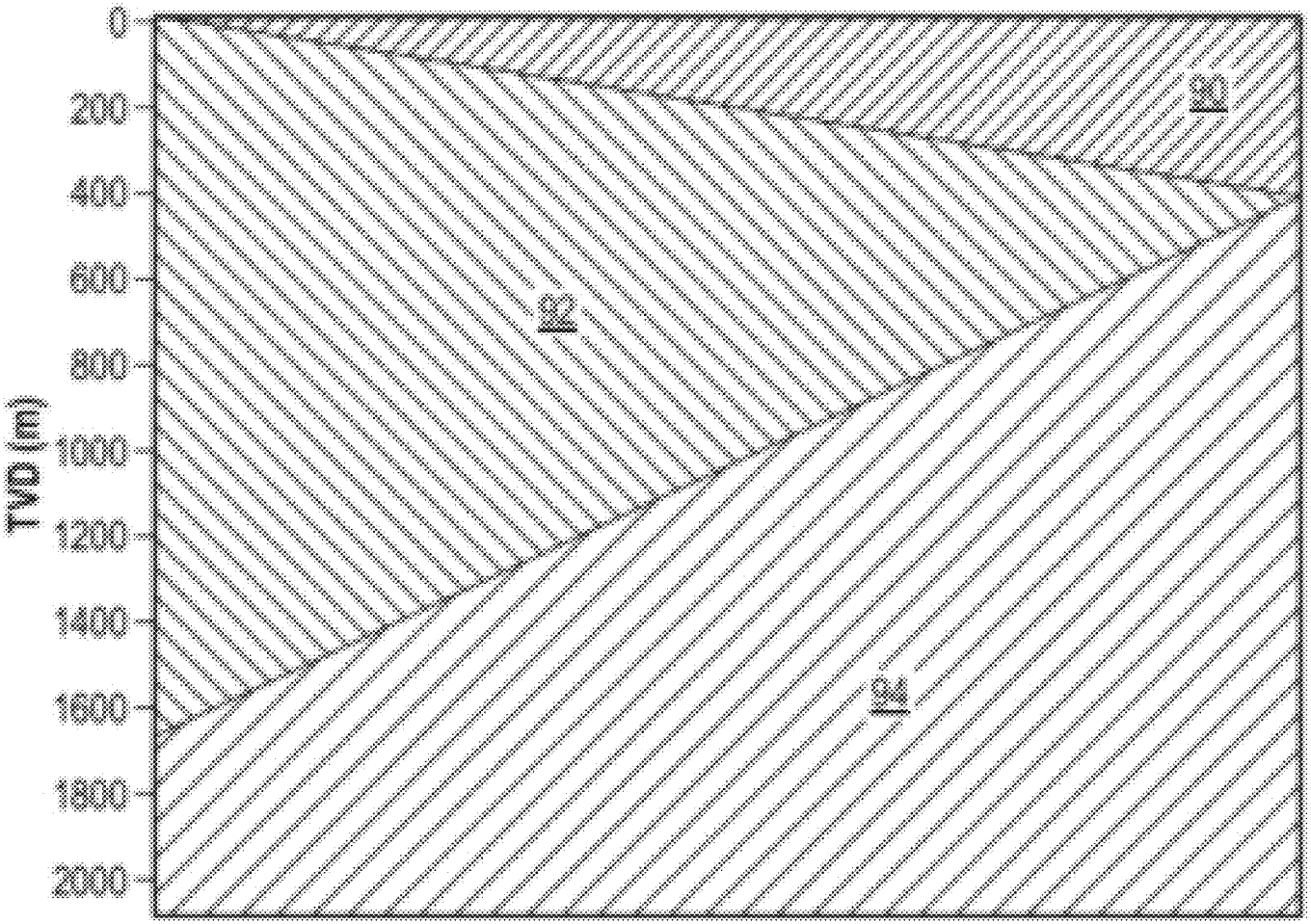
FIG. 4 illustrates an example computation of all possible interfaces, in accordance with embodiments of the present disclosure.

FIG. 4 illustrates an example of all possible configurations of gas 90, oil 92, and water 94 based on equation (2) when, for example, the following are assumed:

$$\rho_g = 10\ \text{kg}/m3,\ \rho_o = 750\ \text{kg}/m3,\ \rho_w = 1000\ \text{kg/m}^3;$$

$$TVD_{dhpg} = 2100\ \text{m, and}$$

$$p_{dhpg}-p_{wh} = 165\ \text{bars.}$$

It can be seen in FIG. 4 that $TVD_{go}$ and $TVD_{ow}$ may vary significantly and that, in this case, there is no possible gas/oil system or single fluid system as some water has to be above the DHPG. As long as $\langle\rho\rangle(MD_{bha}=0)<\rho_w$, many initial combinations are possible. An objective is to determine the actual initial combination by detecting $TVD_{go}$ as early as possible during the first RIH. Once $TVD_{go}$ is known, $TVD_{ow}$ may be estimated, as well as the reservoir pressure $p_{res}$.

Figure 5:
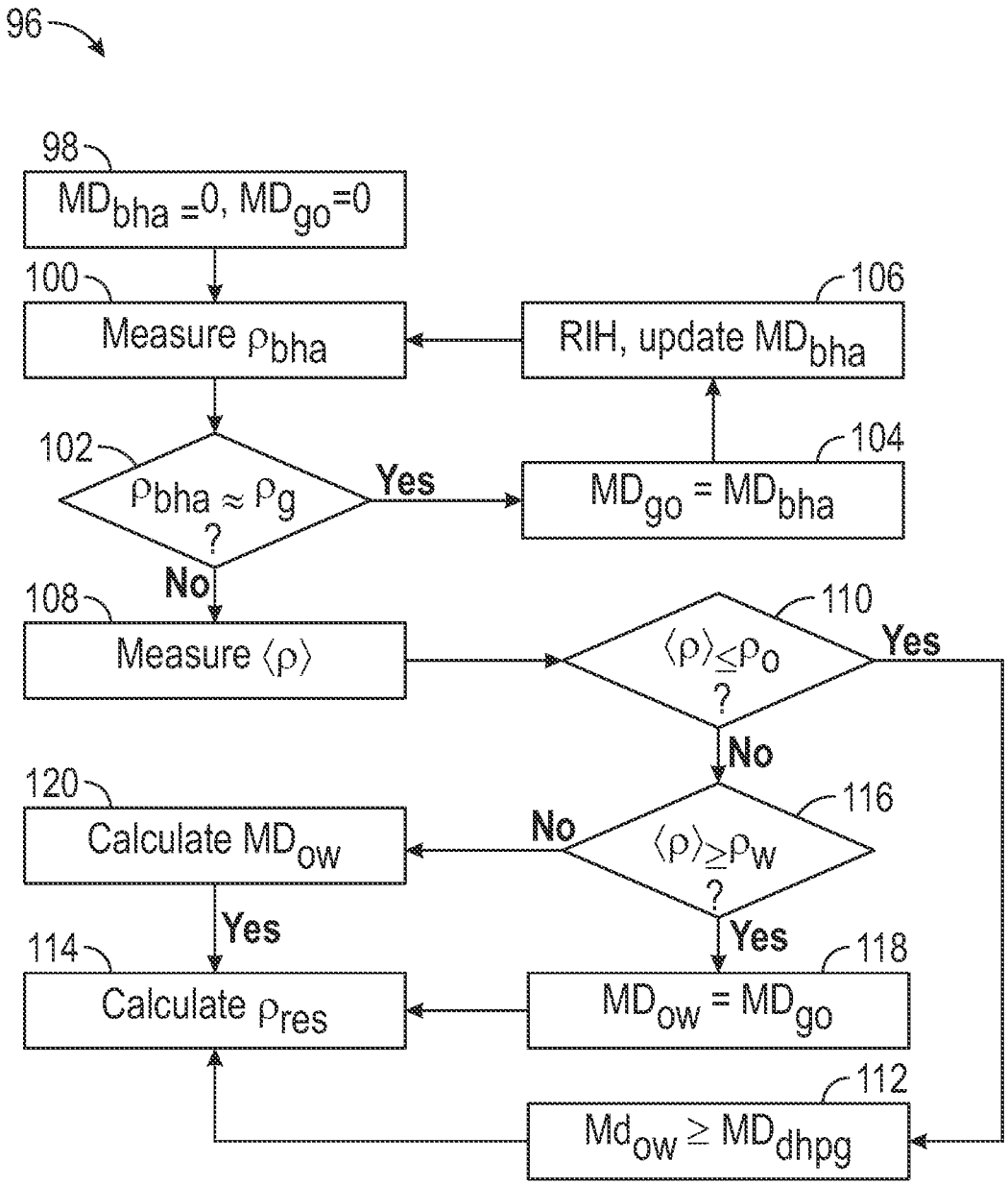
FIG. 5 is a flow diagram for determining initial fluid distribution in a wellbore, in accordance with embodiments of the present disclosure.

The methodology described herein determines the initial fluid distribution according to the flow diagram of the workflow 96 illustrated in FIG. 5. As illustrated, the workflow 96 may begin with $MD_{bha}$ and $MD_{go}$ being set to 0 (block 98). Then, $\rho_{bha}$ may be measured (block 100) and a determination may be made as to whether $\rho_{bha}$ is approximately equal to $\rho_g$ (decision block 102). If $\rho_{bha}$ is determined in decision block 102 to be approximately equal to $\rho_g$, then $MD_{go}$ may be set to $MD_{bha}$ (block 104) and the downhole well tool 36 may be run into the wellbore 14, thereby updating $MD_{bha}$ (block 106), after which the workflow 96 may return back to block 100). Conversely, if $\rho_{bha}$ is determined in decision block 102 to not be approximately equal to $\rho_g$, then <ρ> may be measured (block 108) and a determination may be made as to whether <ρ> is less than or equal to $\rho_o$(decision block 110). If <ρ> is determined in decision block 110 to be less than or equal to $\rho_o$, then $MD_{ow}$ may be assumed to be greater than or equal to $MD_{dhpg}$ (block 112) and $p_{res}$ may be calculated (block 114). Conversely, if <ρ> is determined in decision block 110 to not be less than or equal to $\rho_o$ (i.e., that it is greater than $\rho_o$), then a determination may be made as to whether <ρ> is greater than or equal to $\rho_w$ (decision block 116). If <ρ> is determined in decision block 116 to be greater than or equal to $\rho_w$, then $MD_{ow}$ may be assumed to be equal to $MD_{go}$ (block 118) and $p_{res}$ may be calculated (block 114). Conversely, if <ρ> is determined in decision block 116 to not be greater than or equal to $\rho_w$ (i.e., that it is less than $\rho_w$), then $MD_{ow}$ may be calculated (block 120) and $p_{res}$ may be calculated (block 114).

Physics Concepts

Density calculations and pressure extrapolations may be based on laws of fluid statics. The average fluid density $\rho_{1,2}$ between two True Vertical Depths (TVD) points $TVD_1$ and $TVD_2$ may be estimated using the known pressures $p_1$ and $p_2$ at those points.

$$\rho_{1,2} = \frac{p_2 - p_1}{9.81 \times (TVD_2 - TVD_1)} \tag{3}$$

Equation (3) may also be used to extrapolate pressures at various depths when the pressure is known at a given depth and when the average fluid density is known between the two depths.

Reservoir Pressure Definition

As described in greater detail herein, the reservoir pressure $p_{res}$ may be referred to as the average of the far-field formation pressures in each of the zones connected to the wellbore 14. Average may be defined as the TVD-based wellbore pressure average along the production interval that generates zero net flow. The net flow is the sum of inflow and leak-off rates between the reservoir 16 and the wellbore 14. When such a wellbore pressure is reached, the fluid distribution along the reservoir 16 is steady even if some through-wellbore cross-flow may occur between the various zones of the reservoir 16.

Being above (or below) $p_{res}$ in the wellbore 14 does not guarantee that no leak-off (inflow) occurs locally in a given zone. This depends on the distribution of the zone pressures but without access to this distribution, this remains the only possible indicator to control overall net leak-off and inflow.

Measuring Wellbore Fluid Density Around the BHA Before First Interface

The methodology described herein relies on inferring the wellbore fluid density around the BHA 26 using the real-time measurement of the fluid pressure around the BHA pressure sensor and the WHP sensor. This is done assuming no net flow occurs in the wellbore 14 so that friction pressures are negligible and annular velocities are purely related to the movement of the coiled tubing 20. Additional assumptions include:

- Axial changes of the annular geometry are relatively smooth.
- Deviation angles vary moderately along the wellbore section where the inference is.
- δt may be denoted as a time interval, for example, between two acquisition or interpretation times. z and h(z) may be denoted as the measured depth and the true vertical depth variables when z runs along the hole survey. α(z) may be denoted as the deviation angle at depth z. Therefore:

$$\delta h = \cos(\alpha(z))\delta z. \tag{4}$$

The wellbore fluid density at $z=MD_{bha}(t+\delta t)$ may be determined with following hydrostatic formula:

$$\begin{aligned} p_{bha}(t+\delta t) &= p_{wh}(t+\delta t) + g\int_0^{MD_{bha}(t+\delta t)} \rho(t+\delta t, z)\cos(\alpha(z))dz \\ &= p_{wh}(t+\delta t) + g\int_0^{MD_{bha}(t)} \rho(t+\delta t, z)\cos(\alpha(z))dz + \\ &\quad g\int_{MD_{bha}(t)}^{MD_{bha}(t+\delta t)} \rho(t+\delta t, z)\cos(\alpha(z))dz \end{aligned} \tag{5}$$

The average wellbore fluid density between $MD_{bha}(t)$ and $MD_{bha}(t+\delta t)$ may be defined as follows:

$$\bar{\rho}_{bha}(t, t+\delta t) \equiv \frac{1}{\delta h_{bha}(t, t+\delta t)} \int_{MD_{bha(t)}}^{MD_{bha}(t+\delta t)} \rho(t+\delta t, z)\cos(\alpha(z))dz, \tag{6}$$

with, for example:

$$\delta h_{bha}(t, t+\delta t) = \frac{1}{2}[\cos(\alpha(MD_{bha}(t+\delta t))) + \cos(\alpha(MD_{bha}(t)))](MD_{bha}(t+\delta t) - MD_{bha}(t)). \tag{7}$$

Thus:

$$p_{bha}(t+\delta t) = p_{wh}(t+\delta t) + I + \bar{\rho}_{bha}(t, t+\delta t)g\ \delta h_{bha}(t, t+\delta t), \tag{8}$$

$$I = g\int_0^{MD_{bha}(t)} \rho(t+\delta t, z)\cos(\alpha(z))dz. \tag{9}$$

Using a Taylor development:

$$\rho(t+\delta t, z) \approx \rho(t, z) + \frac{\partial \rho}{\partial t}(t, z)\delta t + O(\delta t^2).$$

The mass balance equation applied along the coiled tubing annulus gives us $$\frac{\partial}{\partial t}(a(z)\rho(t,z)) = -\frac{\partial}{\partial z}(a(z)\rho(t,z)V_a(t,z)), \tag{10}$$

where a is the annulus cross-section area and $V_a$ the annular fluid velocity. If variations in a are assumed to be relatively smooth, the following approximation may be made:

$$\frac{\partial \rho}{\partial t}(t,z) = -\frac{\partial}{\partial z}(\rho(t,z)V_a(t,z)). \tag{11}$$

Therefore:

$$I = g\int_0^{MD_{bha}(t)} \rho(t,z)\cos(\alpha(z))dz - g\,\delta t\int_0^{MD_{bha}(t)} \frac{\partial}{\partial z}(\rho(t,z)V_a(t,z))\cos(\alpha(z))dz, \tag{12}$$

$$I = p_{bha}(t) - p_{wh}(t) - g\,\delta t\int_0^{MD_{bha}(t)} \frac{\partial}{\partial z}(\rho(t,z)V_a(t,z))\cos(\alpha(z))dz, \tag{13}$$

and:

$$p_{bha}(t+\delta t) - p_{bha}(t) - p_{wh}(t+\delta t) + p_{wh}(t) = \delta(p_{bha} - p_{wh})(t, t+\delta t) = \overline{\rho}_{bha}(t, t+\delta t)g\delta h_{bha}(t, t+\delta t) - g\delta t\int_0^{MD_{bha}(t)} \frac{\partial}{\partial z}(\rho(t,z)V_a(t,z))\cos(\alpha(z))dz \tag{14}$$

$$\overline{\rho}_{bha}(t, t+\delta t) = \frac{\delta(p_{bha} - p_{wh})(t, t+\delta t)}{g\,\delta h_{bha}(t, t+\delta t)} + \frac{\delta t}{\delta h_{bha}(t, t+\delta t)}\int_0^{MD_{bha}(t)} \frac{\partial}{\partial z}(\rho(t,z)V_a(t,z))\cos(\alpha(z))dz \tag{15}$$

Inference is intended to occur during the shallower section of the wellbore 14 along which the range of deviation angle is limited. The following may be assumed.

$$\forall z \in [0, MD_{bha}(t)], \cos(\alpha(z)) = c(MD_{bha}(t)) + \epsilon(z) \tag{16}$$

$$c(x) = \frac{1}{x}\int_0^x \cos(\alpha(z))dz \tag{17}$$

$$\overline{\rho}_{bha}(t, t+\delta t) = \frac{\delta(p_{bha} - p_{wh})(t, t+\delta t)}{g\,\delta h_{bha}(t, t+\delta t)} + \frac{\delta t\, c(MD_{bha}(t))}{\delta h_{bha}(t, t+\delta t)}\int_0^{MD_{bha}(t)} \frac{\partial}{\partial z}(\rho(t,z)V_a(t,z))\cos(\alpha(z))dz \tag{18}$$

$$\overline{\rho}_{bha}(t, t+\delta t) = \frac{\delta(p_{bha} - p_{wh})(t, t+\delta t)}{g\,\delta h_{bha}(t, t+\delta t)} + \frac{\delta t\, c(MD_{bha}(t))}{\delta h_{bha}(t, t+\delta t)}[\rho(t,z)V_a(t,z)]_0^{MD_{bha}(t)} \tag{19}$$

The well being shut during the initial RIH, then:

$$\overline{\rho}_{bha}(t, t+\delta t) = \frac{\delta(p_{bha} - p_{wh})(t, t+\delta t)}{g\delta h_{bha}(t, t+\delta t)} + \frac{\delta t c(MD_{bha}(t))}{\delta h_{bha}(t, t+\delta t)}\rho(t, MD_{bha}(t))V_a(t, MD_{bha}(t)). \tag{20}$$

and, if there's no leak-off ahead of the BHA 26, then:

$$V_a(t, MD_{bha}(t)) = -\frac{a_{bha}}{a_{wb}(MD_{bha}(t)) - a_{bha}}V_{CT}(t) = -\beta(MD_{bha}(t))V_{CT}(t). \tag{21}$$

where $a_{bha}$ and $a_{wb}$ are the BHA and wellbore cross-section area, respectively, and $V_{CT}$ is the speed of the coiled tubing 20. If leak-off compensates for the increase of wellbore fluid density sufficiently fast, then:

$$V_a(t, MD_{bha}(t)) = 0, \tag{22}$$

or:

$$\beta(MD_{bha}(t)) = 0. \tag{23}$$

Equation (20) may be generalized as follows:

$$\overline{\rho}_{bha}(t, t+\delta t) = \frac{\delta(p_{bha} - p_{wh})(t, t+\delta t)}{g\delta h_{bha}(t, t+\delta t)} - \frac{\delta t c(MD_{bha}(t))}{\delta h_{bha}(t, t+\delta t)}\rho(t, MD_{bha}(t))\beta(MD_{bha}(t))V_{CT}(t) \tag{24}$$

$$\overline{\rho}_{bha}(t, t+\delta t) = \frac{\delta(p_{bha} - p_{wh})(t, t+\delta t)}{g\delta h_{bha}(t, t+\delta t)} - c(MD_{bha}(t))\beta(MD_{bha}(t))\rho(t, MD_{bha}(t)) \tag{25}$$

It may be assumed that variations of density at the BHA 26 between t and t+δt are relatively small so that:

$$\overline{\rho}_{bha}(t, t+\delta t) \approx \rho(t, MD_{bha}(t)), \tag{26}$$

then:

$$\overline{\rho}_{bha}(t, t+\delta t) = \lambda(MD_{bha}(t))\left(\frac{\delta(p_{bha} - p_{wh})(t, t+\delta t)}{g\delta h_{bha}(t, t+\delta t)}\right), \tag{27}$$

with:

$$\lambda(MD_{bha}(t)) = \frac{1}{g(1 + c(MD_{bha}(t))\beta(MD_{bha}(t)))}, \tag{28}$$

and:

$$0 \le \beta(MD_{bha}(t)) \le \frac{a_{bha}}{a_{wb}(MD_{bha}(t)) - a_{bha}}. \tag{29}$$

Measuring the Average Wellbore Fluid Density Between the BHA and the DHPG

The density of the fluid mixture located between the BHA 26 and the DHPG is obtained by a simple hydrostatic calculation.

$$\langle\rho\rangle(t) = \frac{1}{9.81}\frac{p_{dhpg}(t) - p_{dhpg}(t)}{TVD_{dhpg} - TVD_{dhpg}(t)} \tag{30}$$

This is justified because it may be assumed that no significant flow is occurring during RIH and because surge and swab effects are negligible since the pressure sensor on the BHA 26 is relatively close to the end of the coiled tubing 20.

Calculating the Measured Depth of the First (Gas-Oil) Interface

In practice, pressure measurements may present some noise, and some smoothing in time and space may be used to provide more readable results. As a result, some smearing of fluid-fluid interfaces may be observed, and some sharpening may be required to determine the most likely position of the interface.

Figure 6:
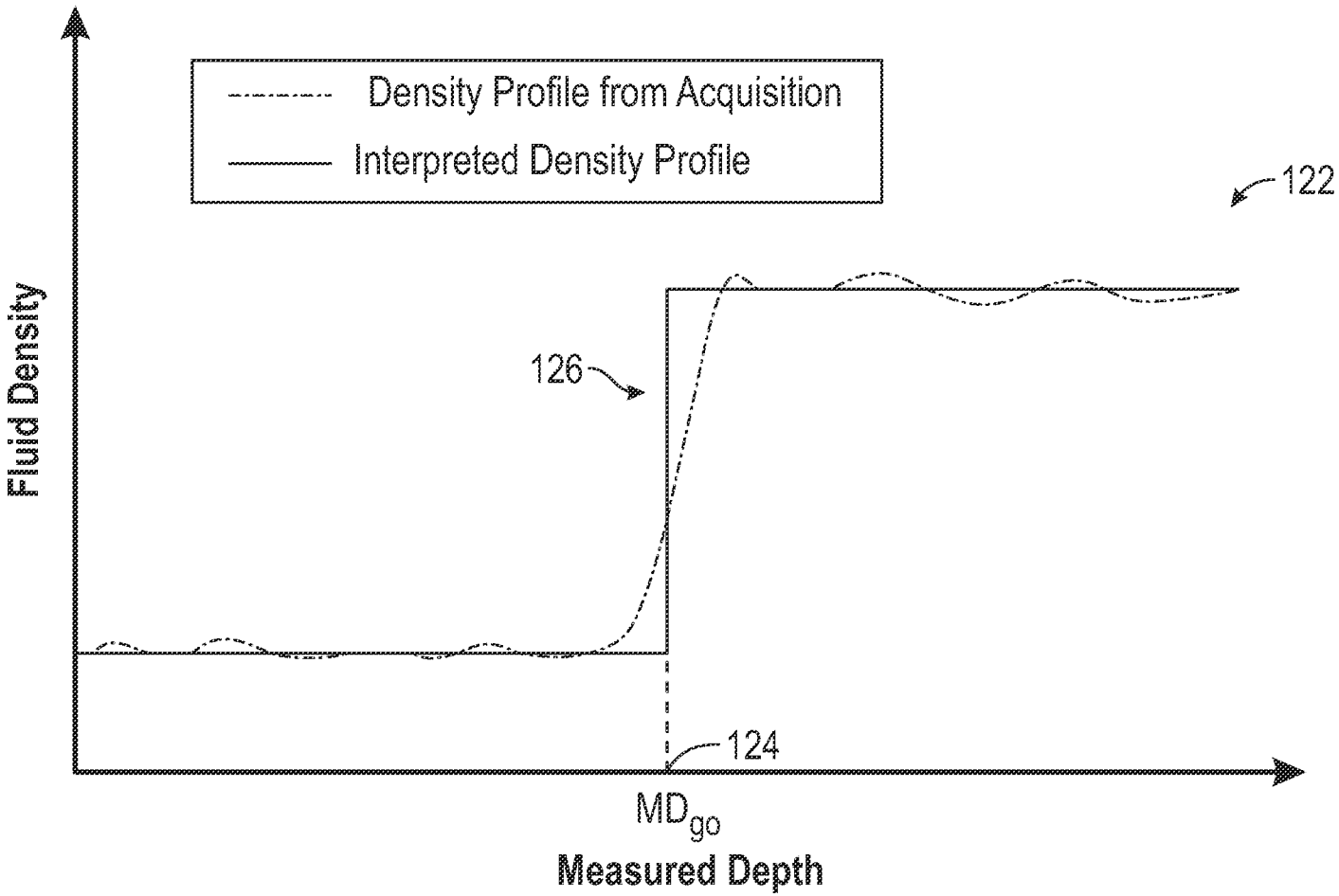
FIG. 6 are density profiles around a fluid-fluid interface as measured from acquisition and interpreted, in accordance with embodiments of the present disclosure.

Once $\overline{\rho}_{bha}$, is detected to be equivalent to $\rho_o$ or $\rho_w$, after it was estimated as $\rho_g$, the calculation of $\overline{\rho}_{bha}$, remains updated with increasing $MD_{bha}$ to ensure the interface is passed entirely. The updating may be performed until a stop criterion is reached, as described in greater detail below. Once the updating is stopped, the density profile 122 of $\overline{\rho}_{bha}$ obtained from acquisition may be approximated by a step function as illustrated in FIG. 6. This approximation is performed using a minimization algorithm that provides the depth 124 at which the step 126 occurs. The depth 124 of this step 126 is taken as the depth of the gas-oil interface ($MD_{go}$). It should be noted that this interface presence does not necessarily mean that oil is the fluid below it. For example, it may be water, in which case, as explained below, it may be determined that $MD_{go}=MD_{ow}$.

Calculating the Measured Depth of the Second (Oil-Water) Interface

Once $MD_{go}$ is passed, there can only be oil (if any) on top of water (if any) between $MD_{bha}$ and $MD_{dhpg}$. This does not exclude the possibility that there is oil or water only between these two depths. The oil-water distribution between $MD_{go}$ and $MD_{dhpg}$ may be uniquely determined using the following hydrostatic relationship:

If $\rho_o<<\rho>\leq\rho_w$, then $$TVD_{go} \leq TVD_{ow} = \frac{(\rho_w - \langle\rho\rangle)\times TVD_{dhpg} + (\langle\rho\rangle - \rho_o)\times TVD_{go}}{(\rho_w - \rho_o)} \leq TVD_{dhpg} \tag{31}$$

- If $<\rho>=\rho_w$ then $TVD_{ow}=TVD_{go}$, there is gas on top of water at $MD_{go}=MD_{ow}$.
- If $<\rho>=\rho_o$ then $TVD_{ow}$ cannot be determined precisely, but $TVD_{ow}\geq TVD_{dhpg}$.

If $\rho_o>\rho>$ or $<\rho>>\rho_w$, then best judgment may be used to determine if the difference may be explained by measurement errors, in which case the fluid may be estimated oil or water, respectively. If the difference is too large, the methodology may indicate that either the initial user input $\rho_o$ or $\rho_w$, on which the methodology rely are flawed or that one of the pressure sensors may be faulty.

Acquisition and Data Quality Control

The real-time 1-Hz frequency estimate of fluid densities using the BHA annular pressure measurement, and/or other pressure gauge data, may lead to relatively noisy results. Therefore, some filtering and smoothing may be required for practical purposes. The following quality control rules have been found efficient at reducing the amount of noise in the context of past CTCOs:

- Use data only before fluid is pumped for the first time.
- Use data only when coiled tubing 20 is being run into hole (downwards motion).
- Use data when the downwards speed of the coiled tubing 20 is above 0.1 m/s.
- For density estimates between two successive positions of the BHA 26, consider TVD difference between 10 m and 30 m.
- Discard any results returning density below gas density and 10% above sea water.
- Perform running averaging over the last 20 s.

Interpretation Stop Criterion for the Determination of $MD_{go}$

The stop criterion is defined to ensure that $MD_{go}$ and $MD_{ow}$ and, therefore, $p_{res}$ may be determined as accurately as possible. It is activated when:

- $TVD_{bha}=TVD_{go}+\Delta TVD$ where $\Delta TVD$ is pre-defined and the value of which comes from experience looking at actual job data (e.g., around 50-100 m)
- $<\rho>$ is sufficiently above $\rho_o$ such that the presence of water is obvious.

The actual adjustment of the stop criterion is based on experience and field validation.

Reservoir Pressure Determination

According to the workflow 96 illustrated in FIG. 5, there are a few situations:

If $MD_{ow}<MD_{dhpg}$ then, by wellbore hydrostatic:

$$p_{res}(TVD) = p_{dhpg} + 9.18\rho_w(TVD - TVD_{dhpg}) \tag{32}$$

If $MD_{ow}\geq MD_{dhpg}$ then, by wellbore hydrostatic:

$$p_{dhpg} + 9.18p_o(TVD - TVD_{dhpg}) \leq p_{res}(TVD) \leq p_{dhpg} + 9.18\rho_w(TVD - TVD_{dhpg}) \tag{33}$$

First Example CTCO

Figure 7A:
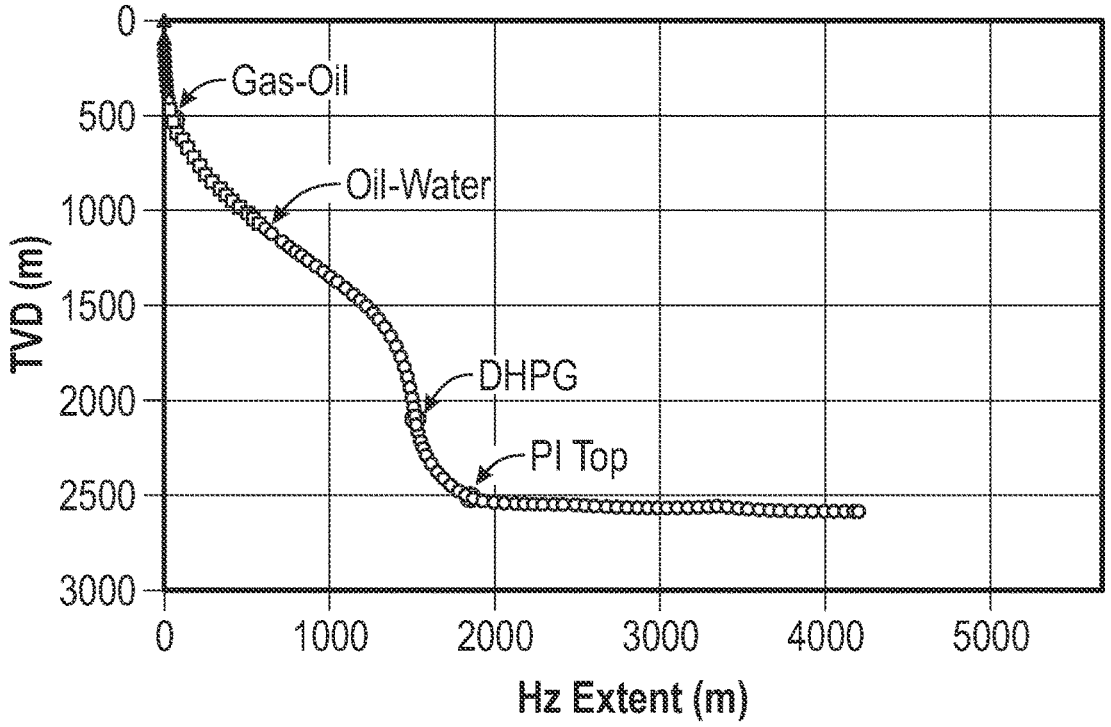
FIGS. 7A and 7B illustrate results of inference plotted on hole survey and measured density profile of fluid in an annulus around a bottom hole assembly (BHA) until gas cap detection, respectively, for a first Cleanout Operations with Coiled Tubing (CTCO), in accordance with embodiments of the present disclosure.
Figure 7B:
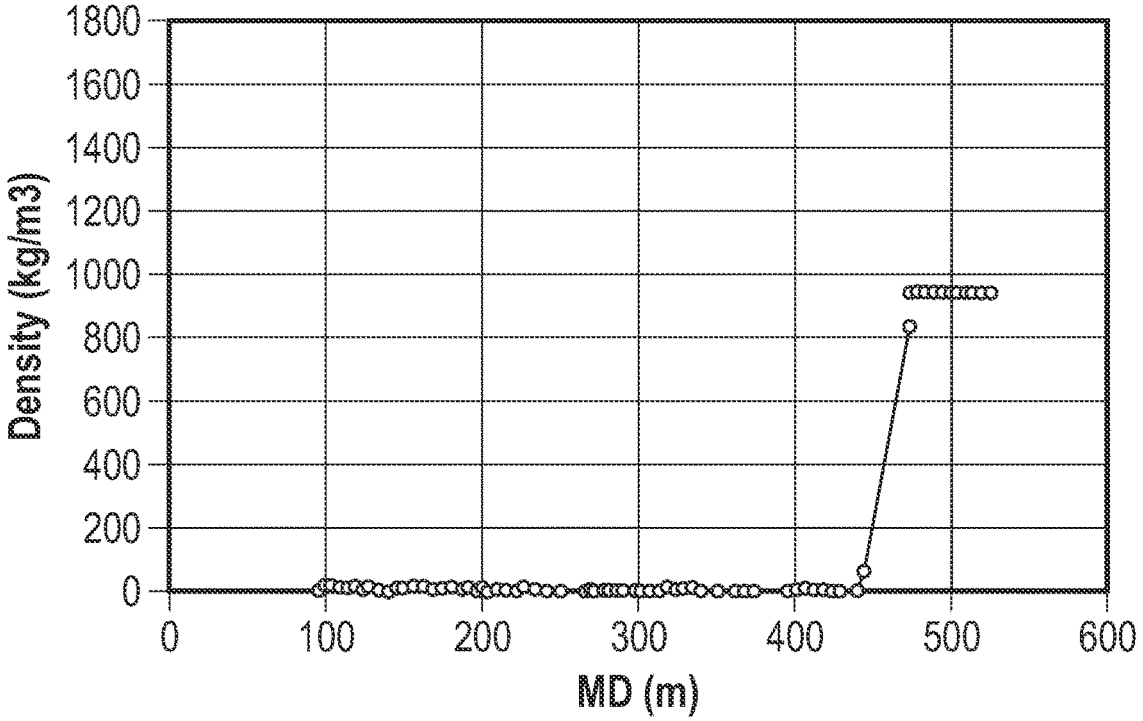
Figure 8A:
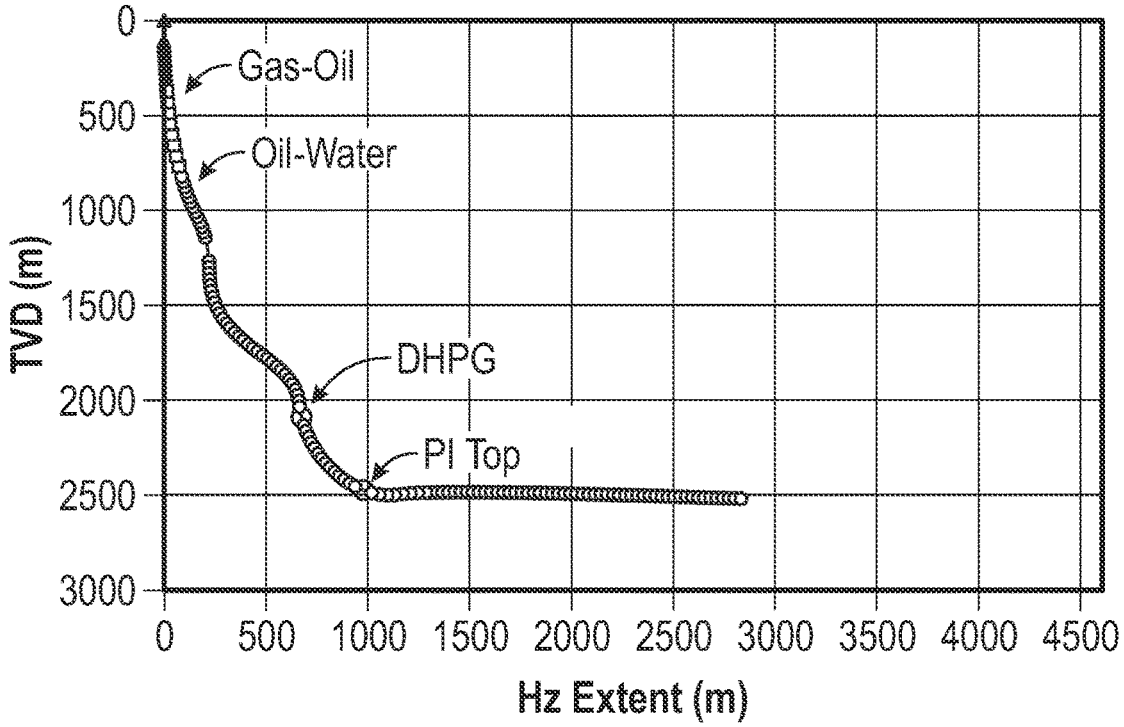
FIGS. 8A and 8B illustrate results of inference plotted on hole survey and measured density profile of fluid in an annulus around a BHA until gas cap detection, respectively, for a second CTCO, in accordance with embodiments of the present disclosure.
Figure 8B:
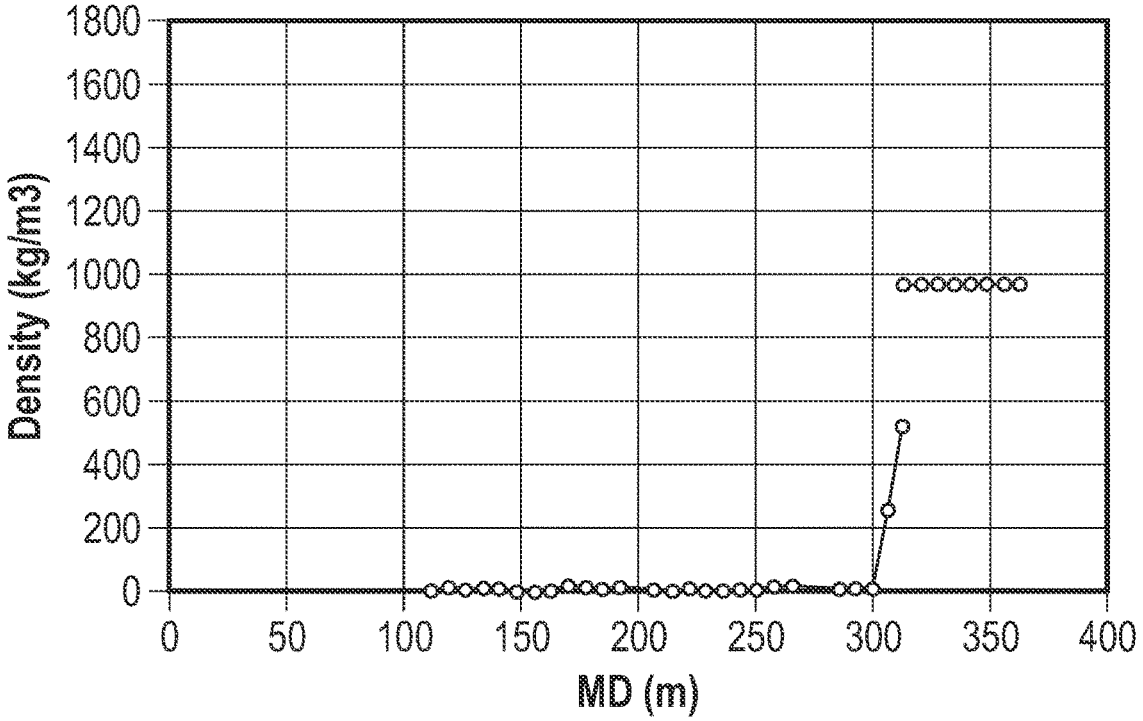
Figure 9A:
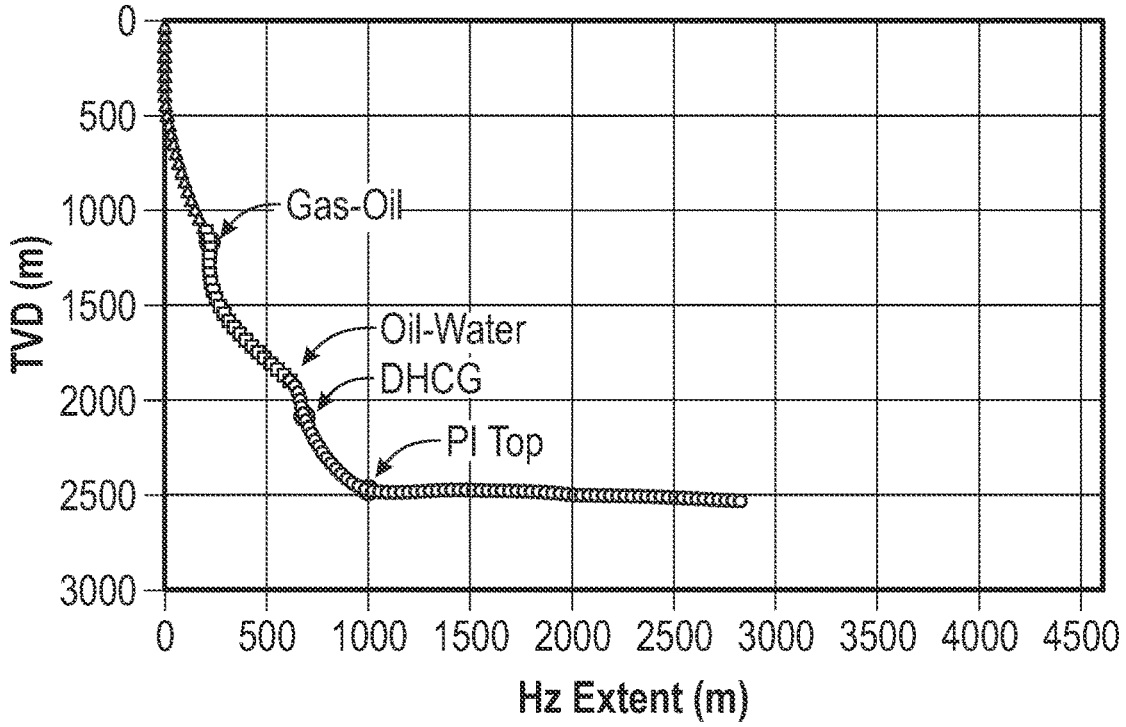
FIGS. 9A and 9B illustrate results of inference plotted on hole survey and measured density profile of fluid in an annulus around a BHA until gas cap detection, respectively, for a third CTCO, in accordance with embodiments of the present disclosure.
Figure 9B:
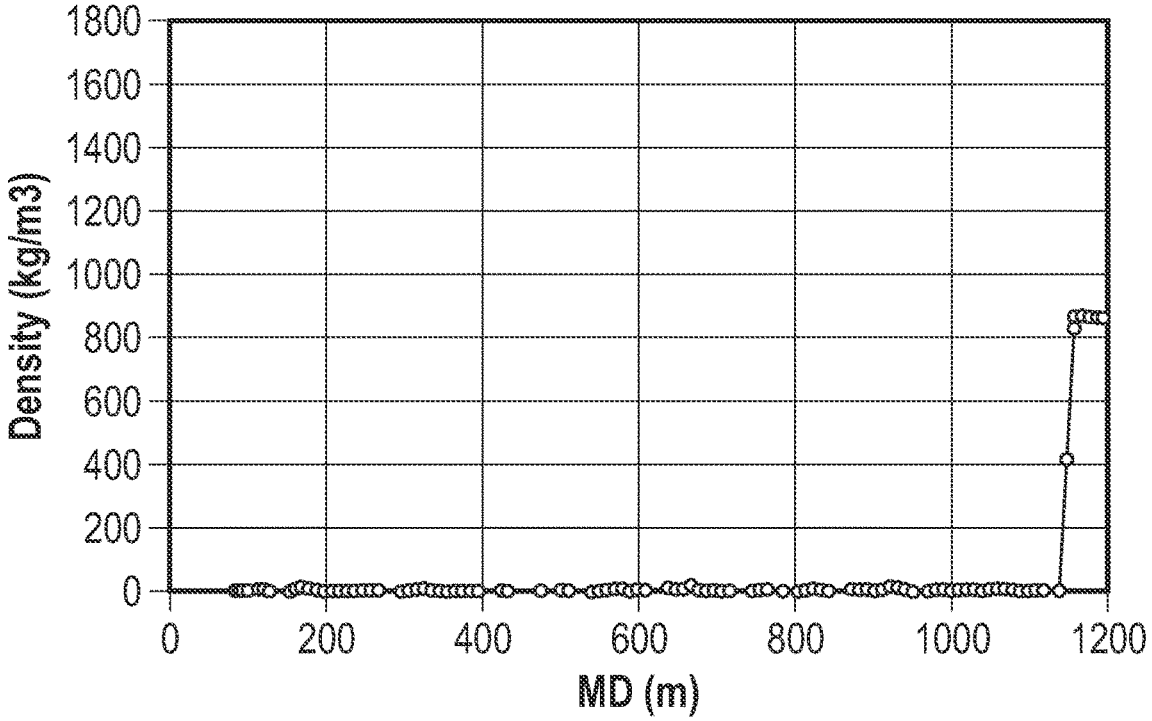

For this CTCO, the following inputs were used to get the following outputs from inference (see FIGS. 7A and 7B):

Input: $\rho_o = 820\ \text{kg/m}^3$, $\rho_w = 1020\ \text{kg/m}^3$, $MD_{dhpg} = 2748$ m Inference: $MD_{go} = 444.6$ m, $MD_{ow} = 1350$ m, $p_{res} = 205$ bars Second Example CTCO For this CTCO, the following inputs were used to get the following outputs from inference (see FIGS. 8A and 8B):

Input: $\rho_o = 840\ \text{kg/m}^3$, $\rho_w = 1030\ \text{kg/m}^3$, $MD_{dhpg} = 2235$ m Inference: $MD_{go} = 306$ m, $MD_{ow} = 843$ m, $p_{res} = 220$ bars Third Example CTCO For this CTCO, the following inputs were used to get the following outputs from inference (see FIGS. 9A and 9B):

Input: $\rho_o = 840\ kg/m^3$, $\rho_w = 1030\ kg/m^3$, $MD_{dhpg} = 2235\ m$

Inference: $MD_{go} = 1148\ m$, $MD_{ow} = 2070\ m$, $p_{res} = 113\ bars$

It is noted that $p_{res}$ has a much lower value than expected (e.g., in the 190-220 bars range) and that its inference may not be accurate in this instance. This is due to the fact that, for an unknown reason, $p_{dhpg}$ started with a very low value at the beginning of the initial RIH (e.g., around 70 bars) and kept rising gradually during RIH towards more realistic values, but the rise was still happening when the inference was done. While the gas cap was tagged successfully, it is possible that the observed and unexplained rise of $p_{dhpg}$ was an indication that the initial wellbore fluids were moving up the wellbore 14 during the RIH and that the system was not static as required for a successful inference. Another explanation was the presence of some physical blockage around the DHPG at the start.

Fourth Example CTCO

Figure 10A:
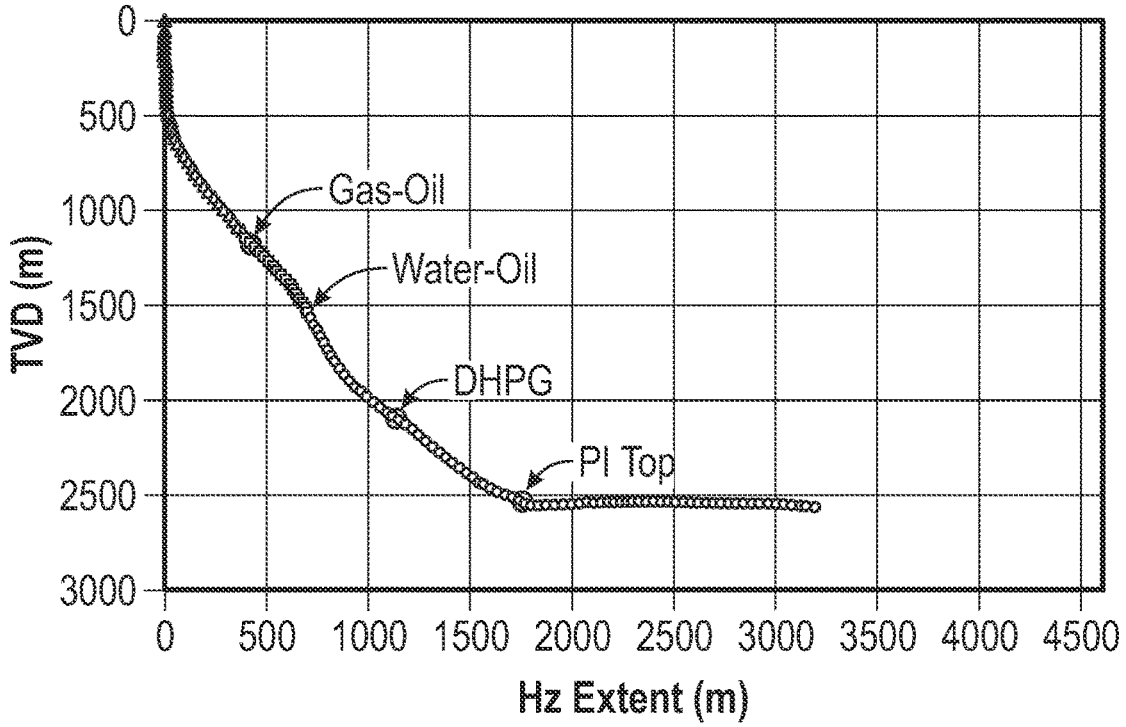
FIGS. 10A and 10B illustrate results of inference plotted on hole survey and measured density profile of fluid in an annulus around a BHA until gas cap detection, respectively, for a fourth CTCO, in accordance with embodiments of the present disclosure.
Figure 10B:
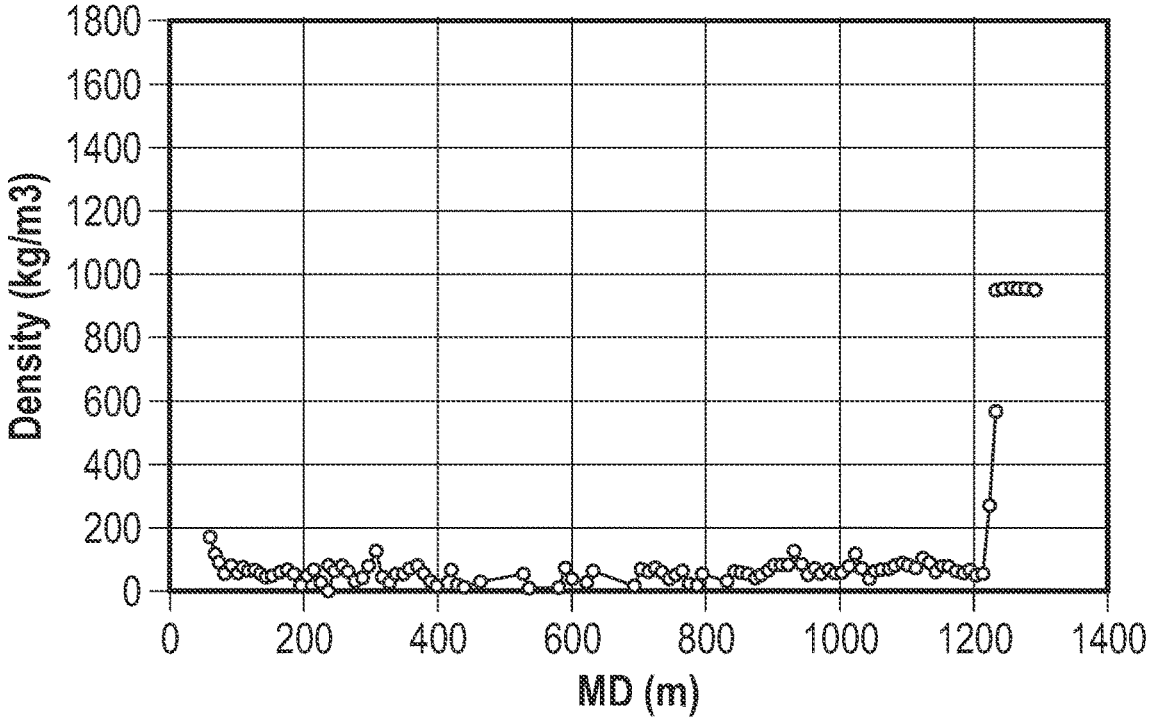

For this CTCO, the following inputs were used to get the following outputs from inference (see FIGS. 10A and 10B):

Input: $\rho_o = 840\ kg/m^3$, $\rho_w = 1030\ kg/m^3$, $MD_{dhpg} = 2470\ m$

Inference: $MD_{go} = 1233\ m$, $MD_{ow} = 1775\ m$, $p_{res} = 220\ bars$

For this CTCO, $p_{dhpg}$ was not logged until pumping started, which means the inference could not take place, in principle. As a post-job analysis, and in an attempt to make the most of the available data, it was assumed that there was a constant offset of 103 bars between $p_{dhpg}$ and $p_{wh}$. This offset value was chosen so that $p_{dhpg}$ would be close to the expected value and consistent with values measured later during the CTCO.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A method, comprising:

performing a coiled tubing operation via a coiled tubing system at least partially disposed within a wellbore;

detecting data relating to one or more operating parameters of the coiled tubing operation via one or more sensors of the coiled tubing system during the coiled tubing operation;

determining an average density of a fluid mixture in the wellbore between a bottom hole assembly (BHA) of the coiled tubing system and a downhole pressure gauge based at least in part on the detected data prior to pumping fluid into the wellbore from a surface location relative to the wellbore; and inferring a reservoir pressure of a hydrocarbon-bearing reservoir through which the wellbore extends based at least in part on the average density of the fluid mixture in the wellbore between the BHA of the coiled tubing system and the downhole pressure gauge.

2. The method of claim 1, wherein the reservoir pressure is inferred by assuming that a measured depth of an oil-water interface in the wellbore is greater than or equal to a measured depth of the downhole pressure gauge when the average density of the fluid mixture in the wellbore between the BHA of the coiled tubing system and the downhole pressure gauge is less than or equal to a density of oil in the fluid mixture.

3. The method of claim 1, wherein the reservoir pressure is inferred by assuming that a measured depth of an oil-water interface in the wellbore is approximately equal to a measured depth of a gas-oil interface in the wellbore when the average density of the fluid mixture in the wellbore between the BHA of the coiled tubing system and the downhole pressure gauge is greater than a density of oil in the fluid mixture.

4. The method of claim 1, wherein the reservoir pressure is inferred based at least in part on a calculated measured depth of an oil-water interface in the wellbore when the average density of the fluid mixture in the wellbore between the BHA of the coiled tubing system and the downhole pressure gauge is greater than a density of oil in the fluid mixture and the average density of the fluid mixture in the wellbore between the BHA of the coiled tubing system and the downhole pressure gauge is less than a density of water in the fluid mixture.

5. A method, comprising:

performing a coiled tubing operation via a coiled tubing system at least partially disposed within a wellbore;

detecting data relating to one or more operating parameters of the coiled tubing operation via one or more sensors of the coiled tubing system during the coiled tubing operation;

determining an initial wellbore fluid distribution in the wellbore based at least in part on the detected data prior to pumping fluid into the wellbore from a surface location relative to the wellbore;

determining an average density of a fluid mixture in the wellbore between a bottom hole assembly (BHA) of the coiled tubing system and a downhole pressure gauge; and inferring a reservoir pressure of a hydrocarbon-bearing reservoir through which the wellbore extends based at least in part on the initial wellbore fluid distribution in the wellbore and the average density of the fluid mixture in the wellbore.

6. The method of claim 5, comprising automatically adjusting at least one adjustable operating parameter of the coiled tubing system based at least in part on the initial wellbore fluid distribution.

7. The method of claim 1, wherein the reservoir pressure is inferred by assuming that a measured depth of an oil-water interface in the wellbore is greater than or equal to a measured depth of the downhole pressure gauge when the average density of the fluid mixture in the wellbore between the BHA of the coiled tubing system and the downhole pressure gauge is less than or equal to a density of oil in the fluid mixture and a density of the wellbore fluid around the BHA is greater than a density of gas in the fluid mixture.

8. The method of claim 1, wherein the reservoir pressure is inferred by assuming that a measured depth of an oil-water interface in the wellbore is approximately equal to a measured depth of a gas-oil interface in the wellbore when the average density of the fluid mixture in the wellbore between the BHA of the coiled tubing system and the downhole pressure gauge is greater than a density of oil in the fluid mixture.

9. The method of claim 1, wherein the reservoir pressure is inferred based at least in part on a calculated measured depth of an oil-water interface in the wellbore when the average density of the fluid mixture in the wellbore between the BHA of the coiled tubing system and the downhole pressure gauge is greater than a density of oil in the fluid mixture and the average density of the fluid mixture in the wellbore between the BHA of the coiled tubing system and the downhole pressure gauge is less than a density of water in the fluid mixture.

10. The method of claim 1, wherein the average density of the fluid mixture in the wellbore between the BHA of the coiled tubing system and the downhole pressure gauge is measured when a density of a fluid in an annulus around the BHA of the coiled tubing system is not approximately equal to a density of gas in the fluid mixture.

11. The method of claim 10, comprising setting a measured depth of a gas-oil interface in the wellbore equal to a measured depth of the BHA of the coiled tubing system, and running the coiled tubing system into the wellbore and updating a measured depth of the BHA of the coiled tubing system when the density of the fluid in the annulus around the BHA of the coiled tubing system is approximately equal to the density of gas in the fluid mixture.

12. A processing and control system, comprising:

one or more processors configured to execute processor-executable instructions stored in memory media of the processing and control system, wherein the processor-executable instructions, when executed by the one or more processors, cause the processing and control system to:

receive data relating to one or more operating parameters of a coiled tubing operation performed via a coiled tubing system at least partially disposed within a wellbore, wherein the data is detected by one or more sensors of the coiled tubing system during the coiled tubing operation;

determine an initial wellbore fluid distribution in the wellbore based at least in part on the data relating to the one or more operating parameters of the coiled tubing operation prior to pumping fluid into the wellbore from a surface location relative to the wellbore;

determine an average density of a fluid mixture in the wellbore between a bottom hole assembly (BHA) of the coiled tubing system and a downhole pressure gauge; and infer a reservoir pressure of a hydrocarbon-bearing reservoir through which the wellbore extends based at least in part on the initial wellbore fluid distribution in the wellbore and the average density of the fluid mixture in the wellbore.

13. The processing and control system of claim 12, wherein the processor-executable instructions, when executed by the one or more processors, cause the processing and control system to automatically adjust at least one adjustable operating parameter of the coiled tubing system based at least in part on the initial wellbore fluid distribution.

14. The processing and control system of claim 12, wherein the reservoir pressure is inferred by assuming that a measured depth of an oil-water interface in the wellbore is greater than or equal to a measured depth of the downhole pressure gauge when the average density of the fluid mixture in the wellbore between the BHA of the coiled tubing system and the downhole pressure gauge is less than or equal to a density of oil in the fluid mixture.

15. The processing and control system of claim 12, wherein the reservoir pressure is inferred by assuming that a measured depth of an oil-water interface in the wellbore is approximately equal to a measured depth of a gas-oil interface in the wellbore when the average density of the fluid mixture in the wellbore between the BHA of the coiled tubing system and the downhole pressure gauge is greater than a density of oil in the fluid mixture.

16. The processing and control system of claim 12, wherein the reservoir pressure is inferred based at least in part on a calculated measured depth of an oil-water interface in the wellbore when the average density of the fluid mixture in the wellbore between the BHA of the coiled tubing system and the downhole pressure gauge is greater than a density of oil in the fluid mixture and the average density of the fluid mixture in the wellbore between the BHA of the coiled tubing system and the downhole pressure gauge is less than a density of water in the fluid mixture.

17. The processing and control system of claim 12, wherein the average density of the fluid mixture in the wellbore is measured when a density of a fluid in an annulus around the BHA of the coiled tubing system is not approximately equal to a density of gas in the fluid mixture.

18. The processing and control system of claim 17, wherein the processor-executable instructions, when executed by the one or more processors, cause the processing and control system to set a measured depth of a gas-oil interface in the wellbore equal to a measured depth of the BHA of the coiled tubing system, and to send a control signal to run the coiled tubing system into the wellbore and update a measured depth of the BHA of the coiled tubing system when the density of the fluid in the annulus around the BHA of the coiled tubing system is approximately equal to the density of gas in the fluid mixture.

* * * * *